US009908669B2

(12) United States Patent
Stratton

(10) Patent No.: US 9,908,669 B2
(45) Date of Patent: Mar. 6, 2018

(54) ANTI-GLUG DEVICE FOR LIQUID CONTAINERS AND POUR SPOUTS

(71) Applicant: Container Packaging Systems, Inc., Churubusco, IN (US)

(72) Inventor: Jon Stratton, Churubusco, IN (US)

(73) Assignee: Container Packaging Systems, Inc., Churubusco, IN (US)

( * ) Notice: Subject to any disclaimer, the term of this patent is extended or adjusted under 35 U.S.C. 154(b) by 0 days.

(21) Appl. No.: 15/614,198

(22) Filed: Jun. 5, 2017

(65) Prior Publication Data

US 2017/0267425 A1 Sep. 21, 2017

Related U.S. Application Data

(63) Continuation-in-part of application No. 14/879,442, filed on Oct. 9, 2015, now Pat. No. 9,669,972.

(60) Provisional application No. 62/061,884, filed on Oct. 9, 2014.

(51) Int. Cl.

| | |
|---|---|
| ***B65D 47/32*** | (2006.01) |
| ***B65D 25/42*** | (2006.01) |
| ***B65D 47/06*** | (2006.01) |
| ***B65D 47/04*** | (2006.01) |
| ***B65D 25/46*** | (2006.01) |
| ***B65D 25/44*** | (2006.01) |
| ***B65D 25/32*** | (2006.01) |
| *B67D 3/00* | (2006.01) |

(52) U.S. Cl.

CPC ..... *B65D 47/32* (2013.01); *B65D 25/32* (2013.01); *B65D 25/42* (2013.01); *B65D 25/44* (2013.01); *B65D 25/465* (2013.01); *B65D 47/043* (2013.01); *B65D 47/063* (2013.01); *B65D 47/06* (2013.01); *B67D 3/00* (2013.01)

(58) Field of Classification Search

CPC ..... B65D 25/32; B65D 25/42; B65D 25/44; B65D 25/465; B65D 47/32; B65D 47/043; B65D 47/063

USPC ..... 222/108–111, 478, 541.9, 526–537, 222/566–574, 543

See application file for complete search history.

(56) References Cited

U.S. PATENT DOCUMENTS

| | | | | |
|---|---|---|---|---|
| 5,791,529 A * | 8/1998 | Mukai | B65D 23/00 | 222/478 |
| 6,845,885 B2 * | 1/2005 | Morgenroth | B65D 47/06 | 222/109 |
| 8,011,535 B2 * | 9/2011 | Tauber | B65D 47/122 | 215/330 |
| 9,669,972 B2 * | 6/2017 | Stratton | B65D 47/32 | |

* cited by examiner

*Primary Examiner* — Paul R Durand
*Assistant Examiner* — Andrew P Bainbridge
(74) *Attorney, Agent, or Firm* — Lempia Summerfield Katz LLC

(57) ABSTRACT

A lid for a liquid container has a lid wall with a perimeter, a top side surface, and an underside surface. The lid has an anti-glug device carried on the lid wall and positioned to coincide with a dispensing orifice in the lid wall. The anti-glug device has a channel that partly circumferentially surrounds the dispensing orifice. Terminal ends of the channel define a circumferential gap therebetween. One or more air vents are formed axially through a part of the channel and are disposed circumferentially opposite the circumferential gap.

25 Claims, 12 Drawing Sheets

ANTI-GLUG DEVICE FOR LIQUID CONTAINERS AND POUR SPOUTS

RELATED APPLICATION DATA

This patent is a continuation-in-part of, and claims priority benefit of, U.S. non-provisional application Ser. No. 14/879,442 filed Oct. 9, 2015, now issued U.S. Pat. No. 9,669,972, which is related to and claimed priority benefit of U.S. provisional application Ser. No. 62/061,884 filed Oct. 9, 2014, each entitled "Anti-Glug Device for Liquid Containers and Pour Spouts." The entire contents of these prior filed applications are hereby incorporated herein by reference.

BACKGROUND

1. Field of the Disclosure

The present disclosure is generally directed to liquid containers and more particularly to an anti-glug device that allows air back into a container to replace lost liquid while pouring liquid from the container.

2. Description of Related Art

Pour spouts that vent (venting spouts), and containers with vents (vented containers) are both known in the art. A typical refillable liquid container of the type that stores liquid and dispenses the liquid from a pour spout has a vent feature or venting capability of some type. The vent is provided to allow air to enter the container as liquid is dispensed in order to replace the lost liquid and equalize pressure in the container. Without such a vent, glugging occurs as a result of return air interrupting the flow of dispensed liquid from the spout. The vent allows the liquid to keep flowing from the container during pouring while return air enters the container via the vent.

More specifically, when liquid flows from a container, a vacuum is created in the vacated interior space in the container. Once the vacuum reaches a certain level, atmospheric air, i.e., return air, is pulled into the container through the dispensing orifice or spout. The return flow of atmospheric air into the container and the flow of liquid from the container utilize the same flow passage or dispensing orifice flow area. The flow of liquid out of the container and the flow of air into the container alternate, depending on the pressure differential in the container. The alternating liquid and air flow causes the glugging action.

In some instances, the vent is provided on the container itself in order to minimize glugging. Such a vent is typically spaced from the dispensing orifice as well as the spout connected to the orifice. The vent on these types of containers typically has its own plug. The plug typically must be manually opened before pouring and then manually closed when done so that liquid does not evaporate from the container during storage. The pour spout also must typically be removed and/or reconfigured when not being used to allow the dispensing orifice to be capped or closed. Also, the dispensing orifice must be capped separately from the vent in order to seal the container for storage and to prevent evaporation. Further, with both the spout and vent opened, if the container is tipped too much during pouring or if the liquid is poured out too quickly, liquid can leak from the vent.

On some containers or products of this type, the pour spout may have a venting feature or vent capability. Some solutions have provided a vent that extends directly through the side of the spout. These types of vents typically leak liquid during the initial pour, at least until air begins to flow back through the vent opening into the container to fill the lost fluid space. Some solutions have provided a vent that extends along the length of the spout. These types of vents typically take a long time to begin allowing return air to reenter the container. This is because the air back flow through the vent passage must first overcome a long column of liquid exiting the vent passage or channel before reaching the container interior. Also, these types of pour spouts typically have a separate air channel and liquid channel along a majority of the spout length. However, the separate channels typically share a single outlet, i.e., an air and liquid passage at the dispensing end of the spout. This can reduce the flow rate of liquid discharged from the spout and can create a significant "glug" effect where air back flow periodically interrupts the liquid flow exiting the dispensing end of the spout.

Other solutions are found on anti-spill pour spouts and other more elaborate systems. Some employ a mechanical shut-off system or valve, which can be costly to manufacture, are likely to be expensive to purchase, and can fail or malfunction during use. Other solutions use a vent that must have a pressure or vacuum differential to open the vent, such as a "duck bill" style valve. A delay typically occurs before the valve opens. Also, the duck bill valve reduces air flow rate through the valve. In containers of relatively heavy wall thickness, the walls do not collapse, which would otherwise aid liquid flow until the valve opens. Also, the size of the valve can limit the flow rate of air back into the container so that the valve cannot keep up with liquid exiting the container.

Large liquid containers, such as five gallon buckets and pails, are provided with separate closures or covers, i.e., lids. The lids are often provided with a pour spout or dispensing orifice to allow controlled pouring of liquid from the container while leaving the lid on the container. These types of containers have similar problems when pouring liquid from the container through the dedicated pour spout or dispensing orifice provided in the lid. Container lids and the spouts for these types of containers were developed in the 1950's. Since their inception, such lids and dispensing spouts have had issues with glugging. Glugging can cause splashing of liquid when pouring from the container. Splashing results in spillage of liquids and spillage results in unnecessary waste and loss of liquid. Depending on the liquid being poured, spillage can also raise environmental concerns and even present a safety hazard. It is nearly impossible to prevent liquid splash caused by glugging, particularly when dispensing a viscous liquid such as motor oil. A common occupational safety hazard is splashing of potentially dangerous chemicals that can harm nearby persons and/or objects. Another common occupational safety hazard is that splashed liquid can contact the eyes of the person pouring the liquid or of other bystanders.

Glugging also can significantly impede pouring or flow accuracy from the container. The intermittent start and stop of liquid flow produced by glugging can cause the flow accuracy to vary widely, such as by six inches or more in some instances. Thus, maintaining pouring accuracy while dispensing from the container into another vessel, such as a funnel, can be quite difficult. These types of containers have often been provided with a separate vent, as noted above, either in the lid or near the top of the container in order to reduce glugging.

Manufacturers of pail and bucket lids have attempted to produce dispensing spouts for the lids that dispense liquids with a continuous liquid flow. However, bucket and pail lid manufacturers have not been successful in producing such a lid. Therefore, the pail lid manufacturers also make and add an additional device to the lid called a back vent that press fits into a hole provided in the pail lid. The end users must open the back vent each time they dispense liquid from the container and then must close the back vent when done to prevent evaporation and contamination of the contained liquid. The back vent allows air into the container, when the vent is open, and thus can reduce the glugging effect.

However, adding the back vent to these types of lids has negative cost and performance implications. Bucket and pail manufacturers must purchase or fabricate the back vents separately and house and store them separately. The manufacturers must also mold or form a separate hole in the pail lid to accommodate the back vent. A production operator must also obtain a back vent for each fabricated lid and then press the back vent into the hole. The increased costs of parts, production, and labor required to make and install a back vent for each lid can add about 20% to the cost of the lid. Such back vents often also will not meet internal container pressure requirements necessary for some hazardous liquids. The internal pressure in a container under a hydrostatic test can cause liquid to leak at the interface between the back vent and the hole in the pail lid. The higher cost and reduced performance of lids with this type of back vent can significantly limit the types of applications and uses for such lids.

SUMMARY

In one example, according to the teachings of the present disclosure, a lid for a liquid container has a lid wall with a perimeter, a top side surface, an underside surface, and a dispensing orifice. An anti-glug device is carried on the lid wall and is positioned to coincide with the dispensing orifice in the lid wall. The anti-glug device includes a channel that partly circumferentially surrounds the dispensing orifice. Terminal ends of the channel define a circumferential gap therebetween. One or more air vents are formed axially through part of the channel and are disposed circumferentially opposite the circumferential gap.

In one example, the lid can include a pour spout having a spout portion carried by and extending from part of the lid wall. The pour spout can have an outlet and can define a liquid flow path in fluid communication with the dispensing orifice.

In one example, the anti-glug device can be integrally formed as a contiguous unitary part of the lid wall.

In one example, the anti-glug device can include an outer wall connected to the lid wall and protruding away from the underside of the lid wall, an inner wall spaced radially inward of the outer wall, and a connecting wall spaced from the underside surface of the lid wall and joining the outer and inner walls.

In one example, the anti-glug device can include a channel that is defined between an outer wall and an inner wall and by a connecting wall connecting the inner and outer walls. Each of the inner, outer, and connecting walls can only partly circumferentially surround the dispensing orifice.

In one example, the one or more air vents can be formed at least in part through a connecting wall of the channel.

In one example, the one or more air vents can be a plurality of holes formed through a wall of the channel.

In one example, the channel can include an inner wall that forms a portion of a liquid flow path radially inward of the inner wall.

In one example, the lid can include a pour spout having a spout portion carried by and extending from part of the lid wall. The pour spout can have a liquid outlet and can define a liquid flow path in fluid communication with the dispensing orifice. The anti-glug device can include an outer wall connected to the lid wall and protruding away from the underside of the lid wall, an inner wall spaced radially inward of the outer wall, and a connecting wall spaced from the underside surface of the lid wall and joining the outer and inner walls.

In one example, the channel can include an inner wall having a diameter that is equivalent to or less than a diameter of a liquid outlet and at least part of a spout portion of a pour spout.

In one example, the channel can include an inner wall that can be sized to restrict liquid flow into a spout portion of a pour spout.

In one example, the lid can include a flow restrictor along a liquid flow path of the dispensing orifice and downstream of an inner wall of the channel. The flow restrictor can be configured to restrict liquid flow into a spout portion of a pour spout.

In one example, the channel can include an outer wall having a diameter that is greater than a diameter of a spout portion at a liquid outlet of a pour spout.

In one example, the anti-glug device can be configured to create a return air flow path above a liquid flow path through the dispensing orifice when the lid is in a pouring orientation.

In one example, at least part of the channel of the anti-glug device can be positioned above a liquid flow path of the dispensing orifice when the lid is in a pouring orientation.

In one example, the one or more air vents can be positioned above a liquid flow path of the dispensing orifice when the lid is in a pouring orientation.

In one example, the lid can include a pour spout. A spout portion of the pour spout can have an attachment end connected to the lid wall. The attachment end can have a larger diameter than a diameter of the spout portion nearer a liquid outlet.

In one example, the channel can have an annular circumferential shape.

In one example, the terminal ends of the channel can be open.

In one example, the circumferential gap can extend at least 90 degrees but less than 180 degrees around the dispensing orifice.

In one example, the channel can include a slot that extends partially circumferentially around the channel and that is disposed opposite the circumferential gap. The channel can include an intermediate wall spaced radially inward of an outer wall of the channel. The slot can be disposed between the intermediate wall and the outer wall. A plurality of vent partitions can be spaced apart along the slot and between the intermediate wall and the outer wall. The one or more air vents can include a plurality of air vents defined between the vent partitions.

In one example, according to the teachings of the present disclosure, an anti-glug device for containers and/or lids is disclosed that can incorporate any combination of the aspects and features of the anti-glug device noted above and/or as described below.

In one example, the terminal ends of the channel can be connected by a band of material that is sized to otherwise leave the circumferential gap between the terminal ends.

In one example, the one or more air vents are formed at least in part axially through a rounded transition between an outer wall and a connecting wall of the channel or at least in part radially through the outer wall of the channel.

In one example, according to the teachings of the present disclosure, an anti-glug device for a liquid container includes a channel that is in flow communication with a dispensing orifice of the container. The channel partly circumferentially surrounds the dispensing orifice. Terminal ends of the channel define a circumferential gap therebetween. One or more air vents are formed axially through part of the channel and are disposed circumferentially opposite the circumferential gap.

In one example, according to the teachings of the present disclosure, a container assembly has a container with a top opening and defines a space therein. The container includes a lid coupled to the container to close off the top opening. The lid can be provided with any combination of the features and aspects noted above and/or described below.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

Figure 1:
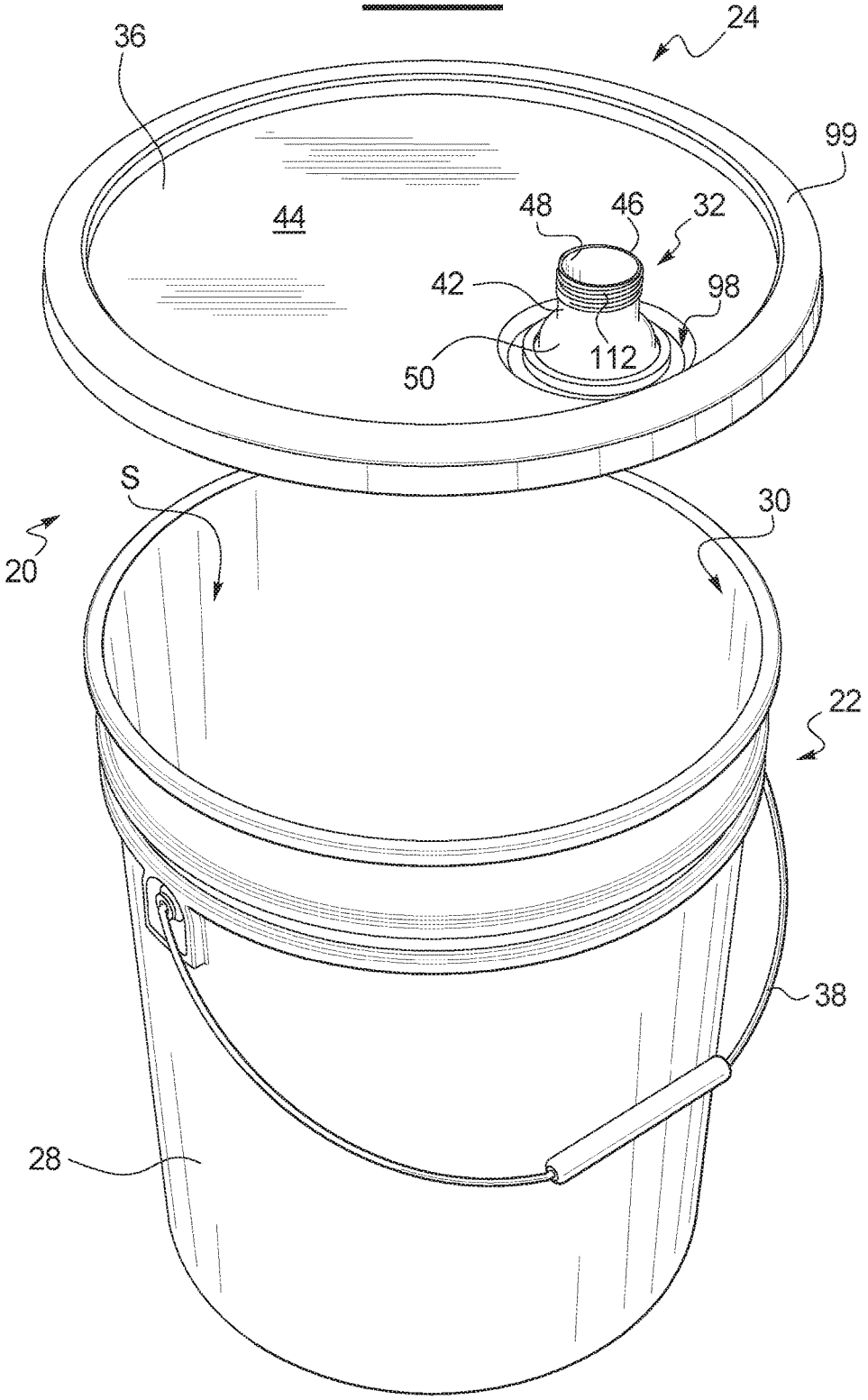
FIG. 1 shows a perspective view of a container assembly constructed in accordance with the teachings of the present disclosure and with the lid detached from the container.

The disclosed anti-glug device embodiments and features are designed to solve or improve upon one or more of the above-noted and/or other problems and disadvantages with prior known vented containers, vented lids, and/or vented pour spouts. Even though the embodiments disclosed herein are specifically for a lid on a container, the concept may be applicable for other types of containers, lids, and/or other types of closures. The disclosed anti-glug concept may be reconfigured for, adapted for, and/or utilized on many different types of liquid containers for dispensing or pouring liquid from the container without glugging. The device is called an anti-glug device herein merely for ease of description, not to limit use of the concept to a particular liquid container, spout, container lid, or the like. It is possible to adapt the disclosed concept to liquid containers of different types.

The proposed anti-glug device solves or improves upon the above-noted cost and performance disadvantages of existing container lids that employ a back vent. The anti-glug device features can be molded directly as a part of a container, and in particular, as a part of the lid such as in the disclosed examples. This reduces the number of manufacturing and assembly operations and reduces the number of separate parts required to create a vented lid. This is because the disclosed device eliminates the need for the separate back vent and the extra hole in the lid or in a container. A continuous, smooth liquid flow can be achieved because the anti-glug device essentially creates separate flow paths for the outgoing liquid and the incoming atmospheric air. Thus, the disclosed anti-glug device design eliminates any alternating liquid flow and air flow glugging action. Additionally, the flow of liquid from the container into the dispensing spout portion of the spout assembly is restricted sufficiently to prevent the dispensing spout portion from filling completely with liquid, which would otherwise restrict return air from flowing back into the container.

In one example, an anti-glug device is disclosed for use on a lid with a spout assembly. In one example, the spout assembly has a pour spout portion on the top side of a lid and the anti-glug device on a bottom side of the lid. In one example, the anti-glug device is configured so as to create a path along the pout spout for return air flow back into the container when liquid is being poured from the pour spout portion. In one example, liquid initially flows from the container through the anti-glug device and then into the pour spout portion of the spout assembly. The configuration and construction of the anti-glug device inhibits the liquid from completely blocking an air flow path created by the device. Thus, air can back flow into the container immediately when necessary to fill the vacuum created by dispensed liquid. These and other objects, features, and advantages of the present disclosure will become apparent to those of ordinary skill in the art upon reading this disclosure.

Figure 2:
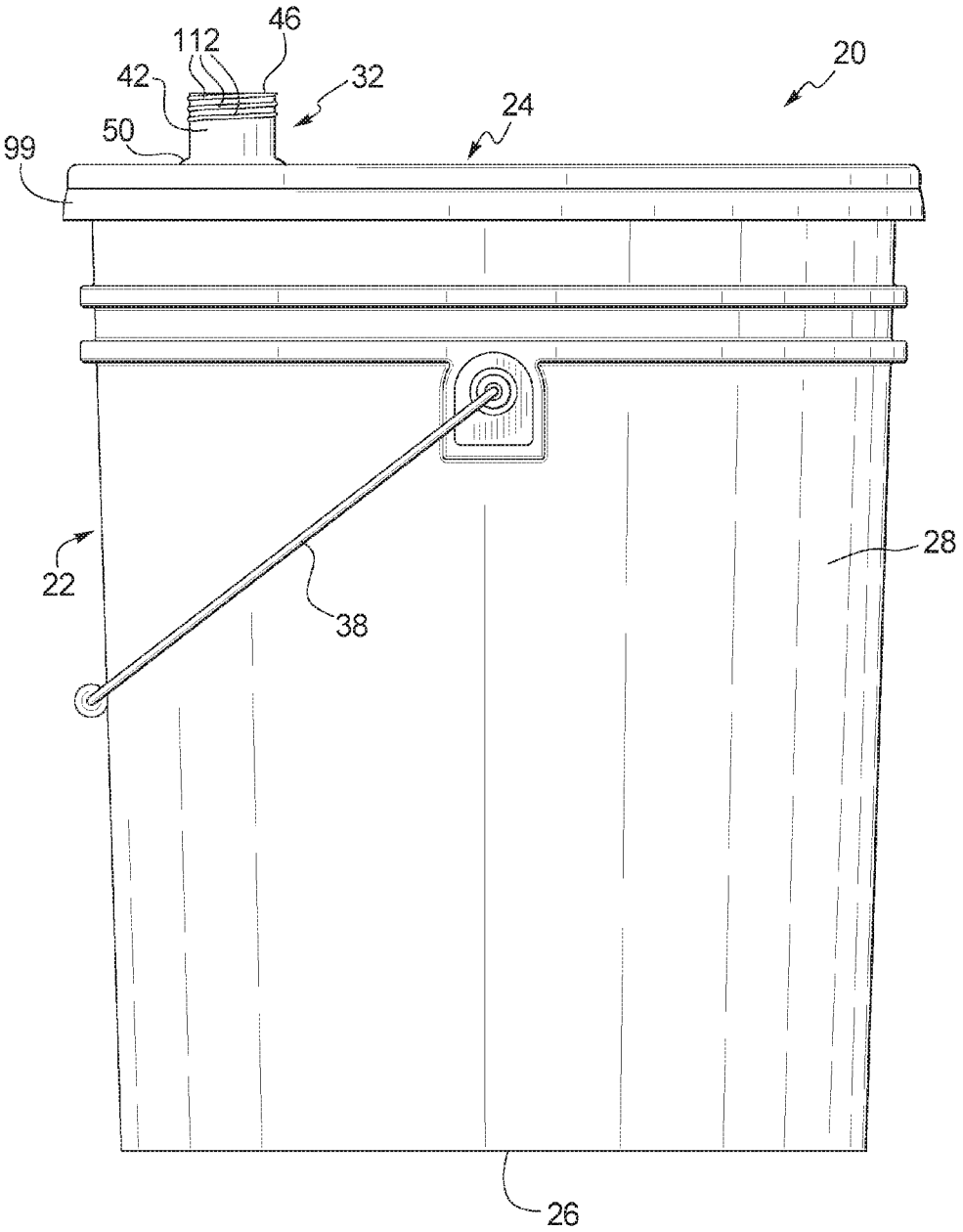
FIG. 2 shows a side view of the container assembly of FIG. 1 and with the lid attached to the container.

Turning now to the drawings, FIGS. 1 and 2 show a representation of a container assembly 20 for liquids, the container assembly constructed in accordance with the teachings of the present disclosure. The container assembly 20 in this example has a conventional or generic liquid container 22, which can be in the form of a five-gallon type pail or bucket. The container assembly 20 also has a lid 24 that is configured to be attached to and removed from the container 22. FIG. 1 shows the container 22 with the lid 24 removed and FIG. 2 shows the lid attached to the container.

As will become evident to those having ordinary skill in the art upon reading this disclosure, the shape, configuration, and construction of the lid 24 and container 22 can vary considerably from the disclosed example. The container can be another type of liquid vessel and the lid can be another type of closure or cap. The container shape and size can vary from the example shown in the drawings. The lid size and shape can vary accordingly. The manner in which the lid attaches to and seals upon the container can also vary. No particular manner is disclosed or described herein, as this aspect of the container assembly is known in the art and has little bearing on the anti-glug feature and device disclosed and described herein. Details of the container can be altered significantly without affecting the disclosed anti-glug function. The container can be plastic, metal, or another material, as can the lid. The container shape can be cylindrical or slightly frusto-conical, or can be rectangular, cuboid, or another suitable shape. The size, configuration, and storage volume of the interior space within the container can also be virtually any desired or suitable size or shape as well. These aspects of the container assembly are not intended to limit the scope of the present disclosure or the appended claims.

The container 22 in this example has a bottom 26 and a cylindrical but slightly drafted or tapered (slight conical shaped) side wall 28 that is larger in diameter away from the bottom and smaller in diameter closer to the bottom. The container 22 also has a top opening 30 at an upper end of the side wall 28. The top opening 30 is closed by the lid 24, as depicted in FIG. 2, and which may typically be designed having a perimeter that is configured to securely attach to and seal the container 20. The lid 24 in this example has a pour spout 32 attached to or carried on the lid and aligned with a dispensing orifice 34 or hole in a top wall or lid wall 36 of the lid. The container assembly 20 can also have a handle 38 coupled to the container 22. Such a handle 38 can be configured for carrying the container assembly 20 or the container 22 and to optionally help with holding the container assembly or container while emptying the container of its contents.

As shown in FIG. 1, the container 22 has an interior space S defined above the bottom 26, within the side wall 28, and below the lid 24 when attached as in FIG. 2. The interior space S typically holds a volume of liquid within the container 22. The space S can be filled and emptied through the top opening 30 in the side wall 28 when the lid 24 is removed. Optionally, the interior space S can also be filled through the pour spout 32 or through the dispensing orifice 34 if the pour spout has been removed, if desired. The present disclosure, however, is directed to dispensing liquid from the container assembly 20 with the lid 24 attached to the container 22 and using the pour spout 32.

Figure 3:
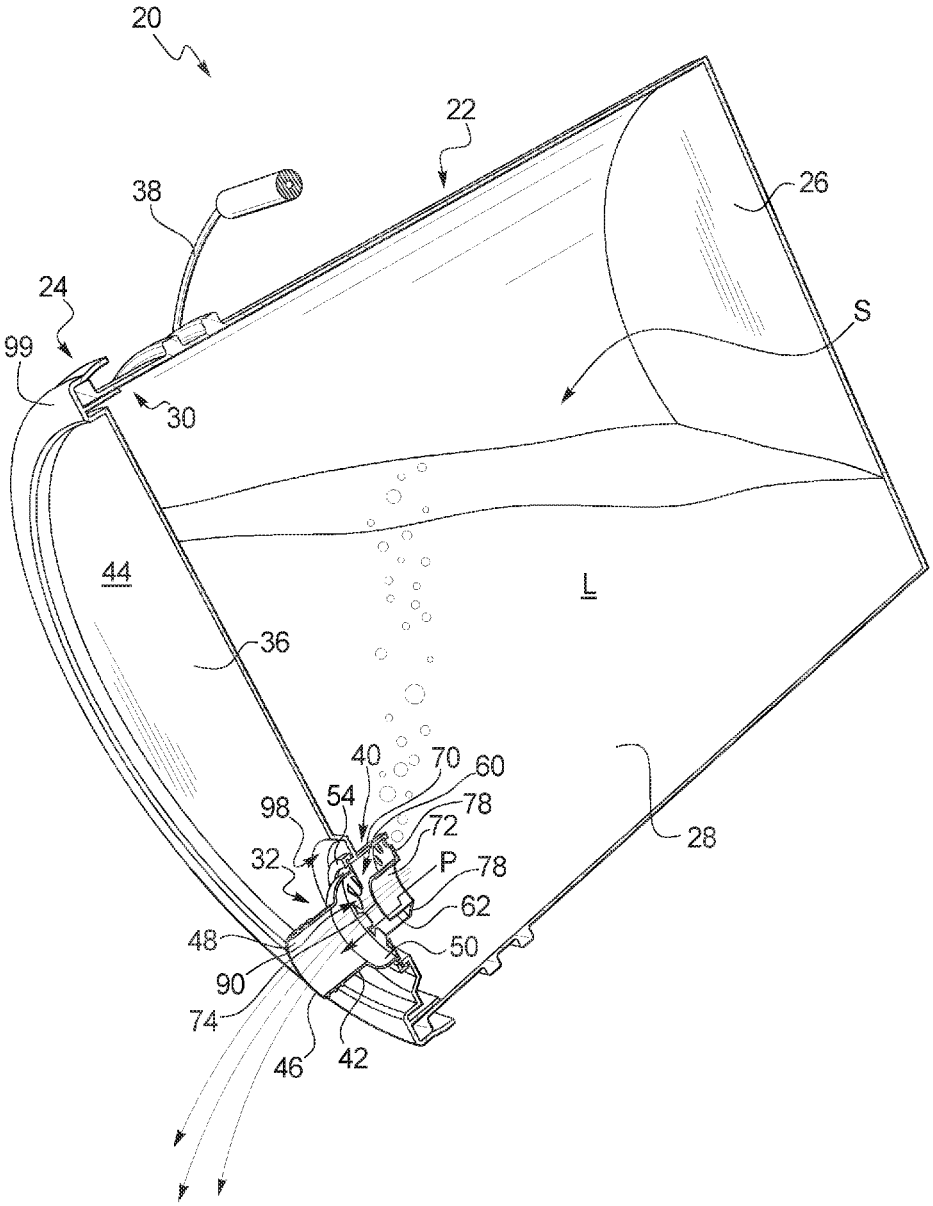
FIG. 3 shows a cross-section taken along line 3-3 of the container assembly of FIG. 2, the container assembly shown inverted and dispensing liquid from a pour spout that has one example of an anti-glug device on the lid.
Figure 4:
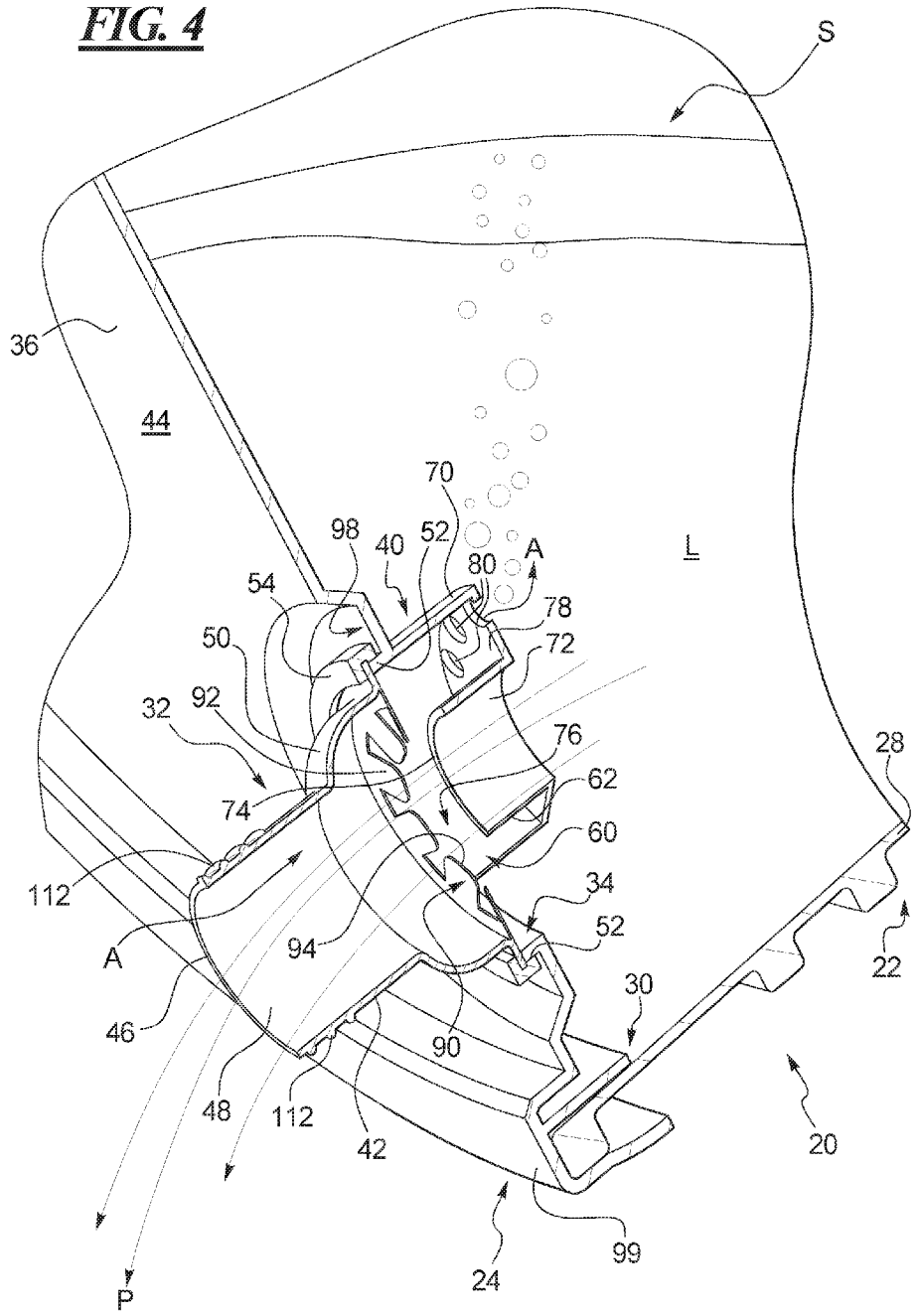
FIG. 4 shows an enlarged detail view of a portion of the container assembly of FIG. 3, including the pour spout and the anti-glug device.

FIG. 3 shows a cross-section of the container assembly 20, which has been partially inverted in order to pour or dispense a liquid L from the interior space S through the pour spout 32. In this example, the lid 24 also has an anti-glug device 40 that is constructed according to the teachings of the present disclosure and that is also attached to or carried on the lid. Details of the disclosed anti-glug device 40 and the pour spout 32 are shown and described in greater detail below. FIG. 4 shows an enlarged portion of FIG. 3 depicting details of the pour spout 32 and the anti-glug device 40.

In this example, the pour spout 32 has a spout portion 42 extending from an outer side 44 of the top wall 36 on the lid 24 (see FIGS. 3 and 4) and away from the container 22 and lid 24. The spout portion 42 is or includes a tubular or cylinder-shaped element that is in flow communication and/or aligned with the dispensing orifice 34 in the top wall 36 of the lid 24. The spout portion 42 has one end, a free or distal end, which defines a dispensing end 46 of the pour spout 32. The dispending end 46 of the spout portion 42 is open and forms a liquid outlet 48 on the pour spout 32. The spout portion 42 defines an internal flow path P of the pour spout 32 that is in flow communication between the interior space S and the outlet 48.

In the disclosed example, the spout portion 42 is a separate tube or tubular element that is attached to the lid 24 surrounding the dispensing orifice 34. In other examples, the spout portion 42 can instead be integrally molded or otherwise formed as a contiguous unitary or monolithic part of the lid 24. In still other examples, the spout portion 42 can instead extend from a part of the container 22 and not the lid 24, and can be either a separate piece of the container or an integral unitary or monolithic part of the container. In the disclosed example, the spout portion 42 has another end, i.e., a proximal end, which is opposite the dispending end 46 and outlet 48. The proximal end defines an attaching end 50, which is configured to connect the spout portion 42 to the lid 24. In this example, the attaching end 50 is a larger diameter segment of the spout portion 42.

The pour spout 32 can be attached to the lid 24 using any suitable means. In one example, the lid 24 can include a raised flange 52 that surrounds the dispensing orifice 34 and protrudes from the top wall 36. The attaching end 50 of the spout portion 42 can be fitted over the flange 52, as shown in FIG. 4. A ring or collar 54 can be positioned around the attaching end 50, capturing the attaching end between a part of the flange 52 and the collar 54. The collar 54 can be crimped or clamped to the flange 52 on the lid 24 around the dispensing orifice. This can secure the spout portion 42 to the flange 52. In the disclosed example, the inside diameter at the attaching end 50 of the spout portion 42 has a diameter that essentially matches that of the outside diameter of the flange 52 around the dispensing orifice 34 on the lid 24. The collar 54 can be configured to optionally fold material of the attaching end 50 of the spout portion 42 onto a top surface of the flange 52 and further optionally onto the inside surface of the flange in order to create a tight, leak-proof connection between the spout portion 42 and the flange 52. A short distance from the attaching end 50, the diameter of the spout portion 42 tapers or necks down to a slightly smaller diameter, best seen in FIG. 4. The remainder of the spout portion 42 to the dispending end 46 is sized at this diameter in this example.

The spout portion 42 can be configured to attach or connect to the lid 24 or container 22 in ways and by means that are different from the example described above and shown herein. In other examples, the attaching end of the spout portion can have male or female threads that screw onto or into a correspondingly or matingly threaded flange or recess on the lid. In still other examples, the collar and flange can include the mating threads and the attaching end of the spout portion can be captured between them when attached. In still further, examples, the spout portion can be attached to the lid or container using an adhesive, chemical bonding, heat welding, metal bonding or welding, or the like, as desired.

The spout portion 42 can be a cylindrical tube attached to the lid 24 and protruding from the top wall 36 of the lid. The diameter and length of the spout portion 42 can vary, as can the size and shape of the liquid outlet 46. The cross-sectional shape of the spout portion need not be cylindrical, but instead can be a different shape, such as elliptical, oval, square, rectangular, or the like. Likewise, the dispensing orifice 34 can also be round or circular, or can have a different shape as well, and can be configured to match the shape of the spout portion at the attaching end. If desired, the spout portion can have the same overall size over the entire length, or can have a varying diameter over the length. The spout portion can also have a consistent cross-sectional shape over the entire length or can have a shape that varies over the length of the spout portion. The pour spout 32 and the spout portion 42 size and form can be varied to accommodate different aspects of a given container.

In general, the anti-glug device 40 creates an air vent or venting function that accompanies and enhances performance of the lid 24 and the pour spout 32. The anti-glug device 40 in this example, is positioned on an underside 56 of the lid top wall 36, as depicted in FIGS. 3 and 4). Depending on the type of container and pour spout or liquid dispenser, the dispensing orifice may be eliminated or may be defined only at the open free end of the spout portion. The anti-glug device 40 in this example is positioned along the flow path P in flow communication with the dispensing orifice 34, the spout portion 42, and the outlet 48.

Figure 5:
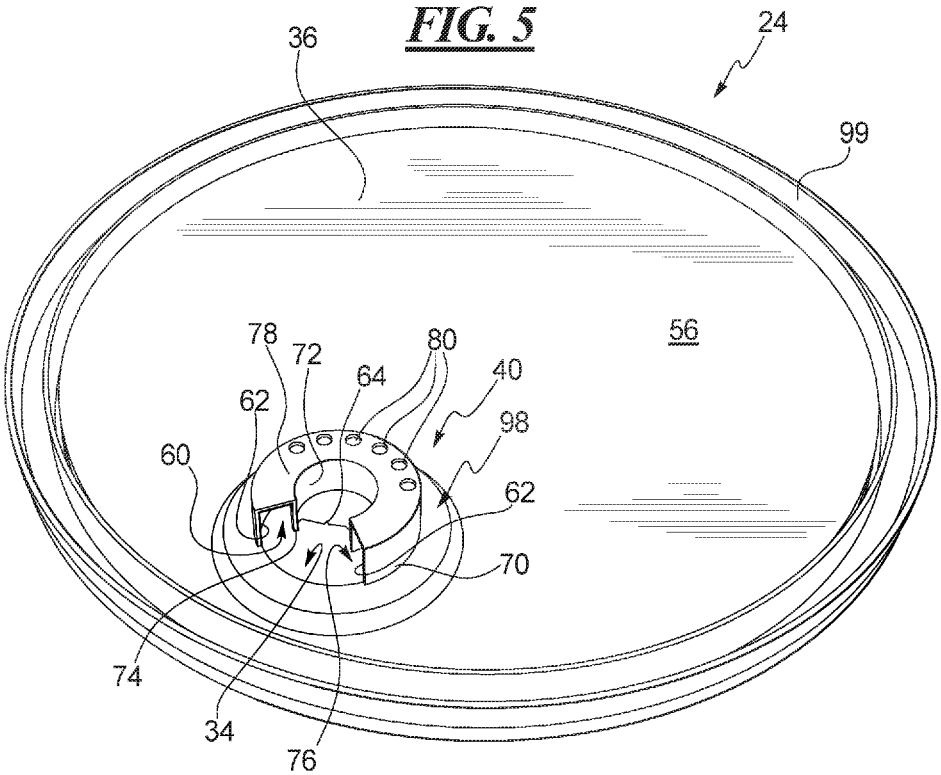
FIG. 5 shows a bottom perspective view of the lid shown in FIGS. 1, 3, and 4 and including a portion of the anti-glug device but without the pour spout.
Figure 6:
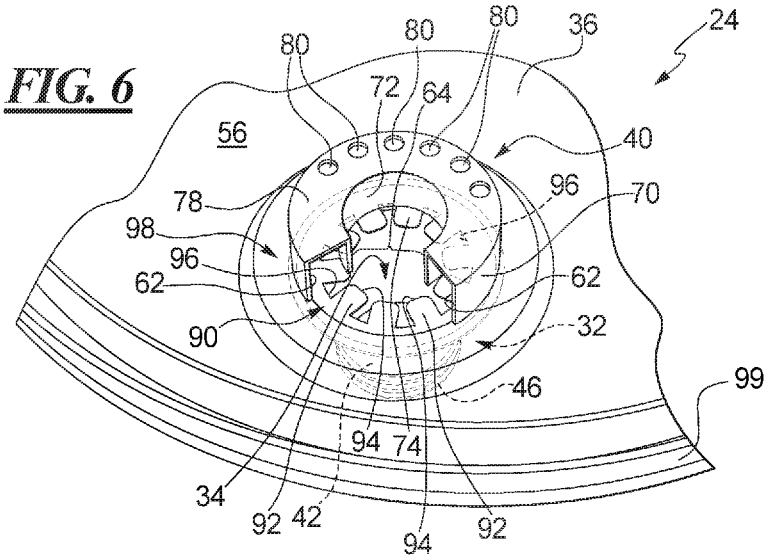
FIG. 6 shows a close-up perspective detail of the lid and the anti-glug device of FIG. 5 and also including the pour spout of FIGS. 1, 3, and 4.

FIGS. 5 and 6 show more detailed views of the anti-glug device 40. In this example, the anti-glug device 40 has a portion that is an integrally molded, contiguous, unitary or monolithic part of the lid 24. However, the entire anti-glug device 40 can instead be one or more separate pieces that are attached to an independently fabricated lid, if desired. Such attachment can be similar to the above described options for the spout portion 42. Thus, the anti-glug device components can be threaded or screwed, fastened, applied by adhesive, chemically bonded, heat welded, metal welded, crimped, clamped, or the like to or on the lid or container. The anti-glug device 40 in this example includes an annular channel 60 that is the monolithic part of the lid 24. The channel 60 is formed on the underside 56 of the lid top wall 36. The channel 60 only partially circumvents, surrounds, or extends around the dispensing orifice 34. The channel 60 is constructed and arranged so that does not completely surround or extend around the dispending orifice 34. In this example, the channel 60 extends around the orifice less than 270 degrees in circumference, as best shown in FIG. 6. A circumferential gap 64 is created between two terminal ends 62 of the channel 60. This circumferential gap 64 is positioned at the bottom of the flow path P of the pour spout 32 and at the top of a column of liquid L when in the pouring or dispensing position of FIGS. 3 and 4. Thus, the channel 60 is positioned around the top of the flow path P and at the top of the liquid column L in the pouring or dispensing position.

Figure 7:
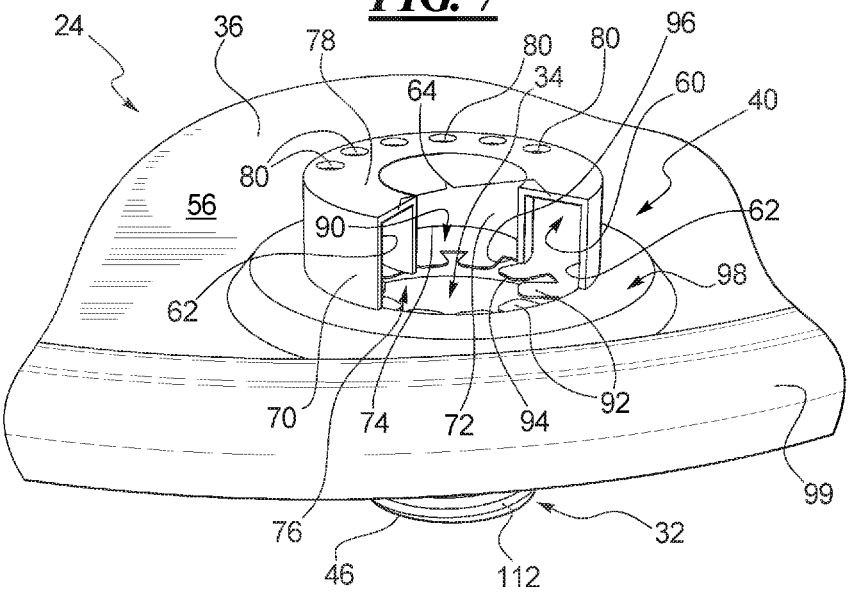
FIG. 7 shows a different perspective view of the pour spout and the anti-glug device of FIG. 5.
Figure 8:
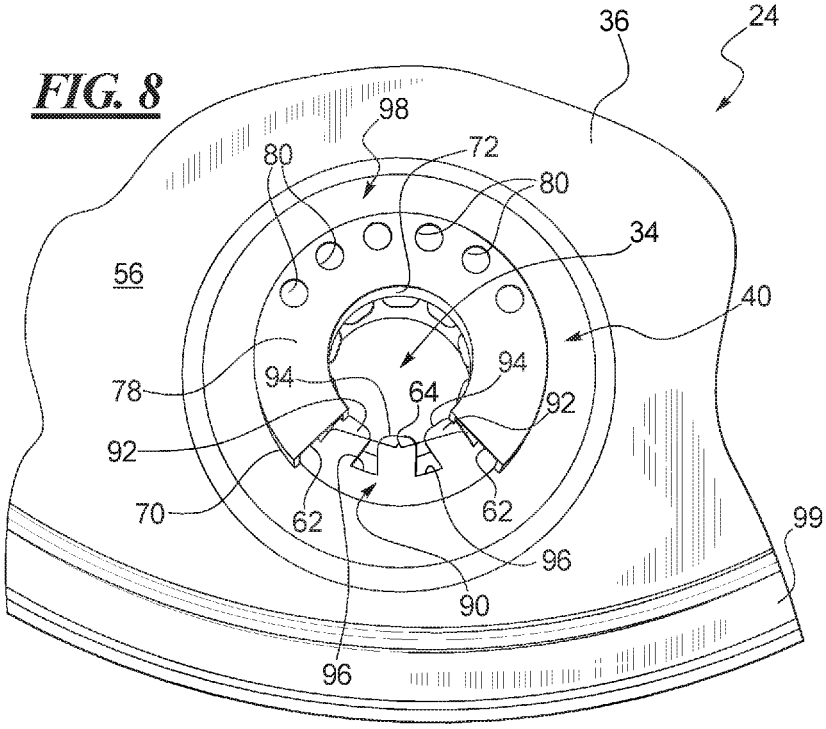
FIG. 8 shows a bottom plan view of the pour spout and the anti-glug device of FIG. 5.

With reference to FIGS. 4-8, the channel 60 has an annular outer wall 70 that is generally radially aligned with the dispensing orifice 34. Thus, the outer wall 70 has a diameter that is about the same size or diameter as the dispensing orifice 34 and thus the attaching end 50 of the spout portion 42 in this example. The outer wall 70 has a proximal end or edge that is connected to the underside 56 of the lid top wall 36 adjacent the dispensing orifice 34, as is shown in FIGS. 4 and 7. The channel 60 also has an annular inner wall 72 that is spaced radially inward from the outer wall 70. The inner wall 72 also has a top edge 74, as shown in FIGS. 4 and 7. However, the top edge 74 is a free exposed edge in that it is not joined to any part of the lid top wall 36. This creates a radial gap 76 or opening in the radial direction into the channel 60 over the inner wall top edge 74. The inner wall 72 in this example is generally radially aligned with and has a similar diameter as the smaller diameter part of the spout portion 42. In this example, the diameter of the inner wall 72 of the channel 60 is slightly smaller than that of the spout portion 42.

The channel 60 also has a connecting wall 78 that joins the respective bottom edges of the inner wall 72 and outer wall 70 of the channel. The connecting wall 78 extends radially between the spaced apart inner wall 72 and outer wall 70. In this example the connecting wall 78 is generally flat like a standard washer but is only a semi-circle sized to match that of the circumferential extent of the channel 60. The channel 60 is defined radially between the inner wall 72 and the outer wall 70 and is axially bound or limited by the connecting wall 78. The terminal ends 62 of the channel 60 that face the circumferential gap 64 or split in the channel are open, as shown in FIGS. 6 and 7.

The walls 70, 72, and/or 78 of the channel 60 of the anti-glug device 40 can have one or more air vents, holes, openings, or slots formed through the wall or walls. In the disclosed example, the channel 60 has a plurality of air vents in the form of holes 80 through the connecting wall as shown in FIG. 5. Thus, the holes 80 in this example provide air vents oriented in an axial direction. The size, shape, positioning, and number of the holes 80 can vary. In one example, the holes 80 can be replaced by one or more slots extending along the connecting wall 78 and through and into the channel 60. In the disclosed example, the connecting wall 78 has six air vents or holes 80, though that number can vary.

The width of the channel 60, defined by the radial spacing of the outer wall 70 and inner wall 72, can vary from the example shown. The positioning of the walls 70, 72 relative to the center axis of the spout portion 42 can also vary from the example shown. In this example, the center axes of the channel 60 and the pour spout 32 are substantially concentric with one another. This may not be the case in some examples as the center axes may be misaligned, as long as the flow path P is open through both the pour spout 32 and the anti-glug device 40. Also, in this example the outer wall 70 is about the same size diameter as the dispending orifice 34 and the inner wall 72 is about the same size diameter as the spout portion 42. This also may not be the case in some examples. The foregoing variables can be determined for specific applications, depending on the size and type of container, the size and length of the pour spout and/or spout portion, and the type and viscosity of the liquid to be contained and poured.

Similarly, the depth or height of the channel 60, i.e., the height of the outer wall 70 and the inner wall 72 and, accordingly, the size of the radial gap 76 between the underside 56 of the lid top wall and the top edge 74 of the inner wall, can also vary from the example shown. The height of the channel 60 is determined in part by the height of the inner wall 72 from the connecting wall 78 to the top edge 74 and in part by the height of the outer wall 70 from the connecting wall to the underside 56 of the lid top wall 36. These characteristics can also vary from the example shown herein. However, testing has shown that as the height of the inner wall 72 approaches half the height of the outer wall 70 or less, the effectiveness of the anti-glug device may rapidly deteriorate at least for some liquids. Testing has also shown that, as the circumferential length of the channel 60 is reduced to 180°, i.e., about half the circumference of the pour spout 32, or if the circumferential length is increased closer to a full 360°, i.e., significantly reducing the size of the circumferential gap 64, the performance of the anti-glug device 40 rapidly deteriorates, at least for some liquids. All of the foregoing design characteristics and the size, number, shape, and positioning of the air vents may vary, depending on the liquid characteristics and the container and spout design characteristics of a given application.

Still further, the channel 60 is shown and described herein as being a contiguous, integral, unitary or monolithic part of the lid 24. As such, the channel 60 can be molded as a part of the lid 24 in the same mold cavity and of the same material. The channel 60 would also require very little to no additional resin material to manufacture. Thus, the channel 60 would require no additional manufacturing steps, other than in the initial tooling of the mold cavity, and would add almost no additional cost to create and add the anti-glug device feature to the lid 24. In fact, the disclosed anti-glug device 40 can reduce lid cost by eliminating the need to manufacture, store, and install a separate vent on each manufactured lid. The substantial anti-glug benefit can thus be gained with virtually no added cost or complexity, and perhaps even with a slight reduction in cost and complexity, to the design and manufacture of the lid or container assembly. However, it is certainly possible that the channel be created as a separate component, which is then after-assembled to the lid, if desired. Such a separate channel could be attached to the lid using any suitable process such as an applied adhesive, chemical bonding, heat welding, metal welding, screw threads, fasteners, press-fit, or the like.

Figure 9:
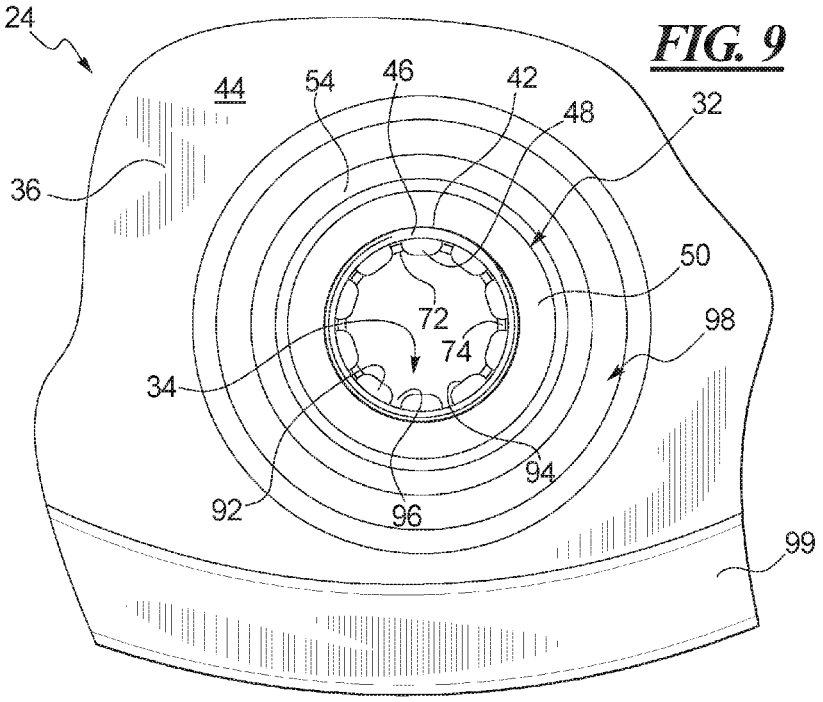
FIG. 9 shows a top plan view of the pour spout of FIG. 1.
Figure 10:
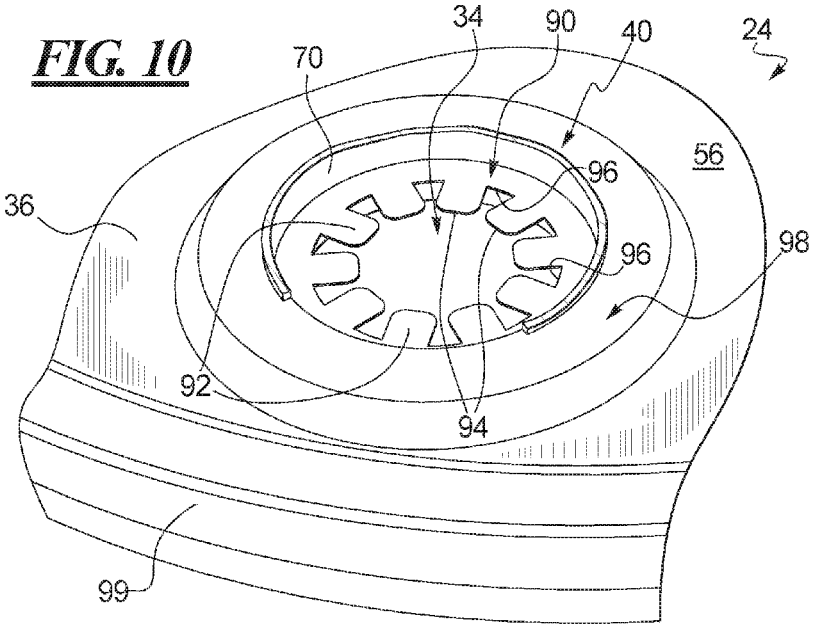
FIG. 10 shows the pour spout and anti-glug device of FIG. 8, but with a channel part of the anti-glug device cut-away.

With reference to FIGS. 4, 6, and 8-10, another aspect of the anti-glug device 40 is also depicted. The anti-glug device 40 can include a liquid column restrictor 90 that at least slightly restricts the flow path P otherwise defined by the pour spout 32. The restrictor 90 is positioned to restrict at least a portion of the liquid column as it is dispensed from the container assembly 20. In the disclosed example, the liquid column restrictor 90 is provided in the form of a plurality of flexible fingers 92, as best illustrated in FIG. 10 with the channel 60 cut away. The fingers 92 surround the flow path P in this example and extend radially inward toward the axis of the flow path P. As depicted in FIGS. 9 and 10, each of the fingers 92 has a somewhat rounded tip 94 and a length that positions the tips 94 slightly further radially inward than the inner wall 72 of the channel 60. Thus, the diameter of the opening defined by and between the tips 94 is less the diameter of the spout portion 42. In this way, the fingers 92 can restrict the diameter of the fluid column flowing into or through the pour spout 32 along the flow path P. The restriction is produced at the axial position of the restrictor 90 or fingers 92. The fingers 92 are spaced apart in this example with a space 96 between each adjacent finger pair. The spaces 96 and the opening defined between the tips 94 allow liquid to flow along the flow path P, but with some degree of restriction of the liquid column. This restriction has been shown through testing to substantially improve the performance of the anti-glug device 40, at least for some liquids and at least for the channel 60 and spout 32 configuration disclosed herein.

In one example, the fingers 92 can be formed as an integrated, monolithic part of the pour spout 32, such as at the terminus of the attaching end 50, as in this example. In other examples, the restrictor 90 or such fingers 92 can be formed as a separate element and added to the pour spout and/or anti-glug device during assembly. In this example, the attachment end 50 of the spout portion 42 is fabricated to integrally include the plurality of fingers 92 protruding radially inward into the flow path P. The fingers in this example are thus downstream closely adjacent the channel 60, as depicted in FIG. 4. Such fingers are known as part of existing spout assemblies and are disclosed and described in U.S. Pat. No. 8,292,133, assigned to Rieke Corp of Auburn, Ind.

In this example, the axial opening between the tips 94 of the fingers 92 can have a different size or diameter than that described above and can be greater than, less than, or about the same diameter as the primary flow path P. The spaces 96 between the fingers 92 can also vary from the example shown to accommodate different liquids and different applications. The fingers 92 can also be positioned further downstream of the channel 60, if desired. The fingers 92 are just one example of a flow restrictor 90 that can be designed and positioned to at least slightly restrict the fluid column flowing along the flow path P. The fingers 92 can be varied in width, shape, length, and/or spacing from the example shown.

The fingers 92 can be completely replaced by one or more other elements positioned within and along the flow path P to restrict flow. The restrictor 90 can be added to create turbulent flow characteristics or to otherwise restrict or impede the flow path P of the liquid column flowing through the anti-glug device 40 and the pour spout 32. The liquid flow restrictor 90 may help to direct liquid flow radially inward along the flow path P to inhibit the channel 60 from completely filling with liquid during an initial pour. This may also assist in creating available return air flow space, as can the size of the flow passage through the anti-glug device 40, as defined by the inner wall 72 radius, compared to the diameter of the spout portion 32 and the outlet 48. The restrictor 90 may also help to control the flow pressure or volume to insure a smooth and continuous column of liquid from the container. The size, positioning, radial extension, and/or spacing of the one or more restrictor 90 elements can be designed and tuned for a given application to improve performance of the anti-glug device while permitting sufficient flow of liquid exiting the container. The restrictor may simply be a funnel shaped ring or the like that is placed downstream of the channel 60 to create a flow restriction along the flow path P. The flow restriction can help keep the channel from filling with water and can help keep the air vents or holes 80 clear for when return air flow into the container 22 is needed. The fingers 92 or other restrictor 90 elements can also be flexible so that they bend in the direction of liquid flow so as not to overly impede the flow of liquid form the container.

Through testing, and using the fingers 92, the fingers were eliminated one by one to determine the effectiveness of the channel 60 with or without the flow restrictor 90 function. Testing was conducted relative to the fingers 92 at the top of the fluid column and at the bottom of the fluid column flowing along the flow path. Such testing showed that removing the flow restriction at either the top (in front of the channel 60 and holes 80) or the bottom (opposite the channel) of the liquid column L reduces the effectiveness of the channel 60. Upon removal of each finger, the anti-glug function was diminished. Upon removal of four of the ten fingers (40% of the circumference of the restrictor 90), the anti-glug function was almost entirely diminished. This occurred for both the top and bottom fingers. Thus, it was determined that, at least for this particular example, the channel 60 of the anti-glug device 40 performed significantly better in eliminating glugging if the flow restrictor 90 completely circumferentially surrounded the flow path P, thus acting as a true flow restriction for the size of the pour spout 32. The restrictor 90 prevents the channel 60 and air vents or holes 80 from completely filling with water before the flow of return air begins, which permits immediate return air flow when needed. This prevents glugging at the outset of pouring liquid from the container. The channel 60 and air vents or holes 80 continue to prevent glugging air return air is flowing back into the container 22 while pouring.

The function of the anti-glug device 40 is described with reference to FIGS. 3 and 4. The anti-glug device 40 creates an air flow path for return air flow into the container 22 that is essentially always open and available when pouring liquid L from the container. FIG. 3 shows the container assembly 20 of FIGS. 1 and 2 in cross-section and inverted for pouring liquid from the container 22. Liquid L exiting the container 22 will flow via the flow path P through the pour spout 32. With reference to FIG. 4, the liquid will first flow into the pour spout 32 through a passage defined by the inner wall 72 of the channel 60. As noted above, this passage is sized slightly smaller in diameter than the diameter of the spout portion 32 and the outlet 48. Liquid might also initially and temporarily flow through the air vents 80 and within the channel 60 at the outset of a pour. However, the channel 60 is positioned radially outward of the primary liquid flow path P, i.e., the passage of the anti-glug device 40 via the inner wall 72 and then downstream through the spout portion 42. Also, the restrictor 90, i.e., the fingers 92 in this example, will further restrict the liquid column to the size of the opening between the fingers, which is slightly smaller in diameter than even the passage within the inner wall 72. This will further aid in preventing the channel 60 and air vents 80 form completely filling with liquid during the initial pour.

As soon as the pressure differential (vacuum within the interior space S of the container 20 created by lost liquid L) exceeds the head pressure of the liquid exiting the spout portion 42, return air A will flow back into the outlet 48 of the spout portion 42 along the top of the flow path P. The return air will flow to and into the channel 60 and through the air vents or holes 80. As return or replacement air starts flowing in the direction of the arrow A in FIG. 4, the geometry of the passage through the anti-glug device 40, the flow path P, and the restrictor 90 allows air to flow continuously and freely along the top of the pour spout 32 to the channel 60 of the anti-glug device 40. The channel 60 is positioned above and radially outward of the primary liquid flow path P in the tipped container pouring orientation. Air will naturally flow along the top of the flow path P. Likewise, the air vents 80 are also positioned at the top of and radially outward of the primary liquid flow path P in the tipped container pouring orientation. The anti-glug device will likely not function if the channel and air vents were at the bottom of the blow path P. The disclosed anti-glug device 40 eliminates any glugging while pouring from the container 20. The result is a smooth and continuous liquid flow from the outlet 48 of the spout portion 42. Testing has proven that glugging can be eliminated using the disclosed anti-glug device design.

The cross-sectional size and shape of the channel 60 can be varied to fine tune the flow characteristics for a particular application and for particular liquids. The tapered area at the attachment end 50 of the spout portion 42 can also be altered, tuned, or eliminated to tune the flow characteristics for a particular application and for particular liquids. Likewise, the placement of the air vents 80 as well as the number, size, positioning, and shape of the air vents can also be varied to change the flow characteristics. Testing has shown that varying the geometry of the air vent portion can affect the flow pattern. The air vents can be partly or entirely on the outer wall 70, inner wall 72, and/or connecting wall 78. The air vent or vents 80 can be tuned to a particular application and for particular liquids through testing. The function and performance of the air vents and the anti-glug device, including how quickly the air vents begin to permit return air flow after initial pouring, can be designed and tuned to a particular application. The circumference of the channel 60 can increased or decreased from the example shown and described herein to further tune the performance of the disclosed vented spout. The channel need not have a circular or annular profile, but instead can be oval shaped, oblong shaped, shaped having linear segments such as a partial octagon, square, rectangle, or other such non-circular shape, or the like.

The spout portion 42 of the pour spout 32 can be attached to the lid 24 at the dispensing orifice 34, as described above. In the inverted or dispensing orientation, the container 20 can be at least somewhat tipped to dispense some of the liquid from the interior space, or can even be nearly completely inverted so that nearly all of the liquid can be dispensed. In order to completely empty the interior space S, the bottom 26 of the container 20 is typically elevated at least part way above the top opening 30 with the outlet 48 of the spout portion 42 near the lowest elevation of the container. This allows gravity to draw liquid down toward the dispensing orifice 34. The anti-glug device 40 disclosed herein will allow air to replace as much lost liquid L that is dispensed from the container 20.

Figure 11:
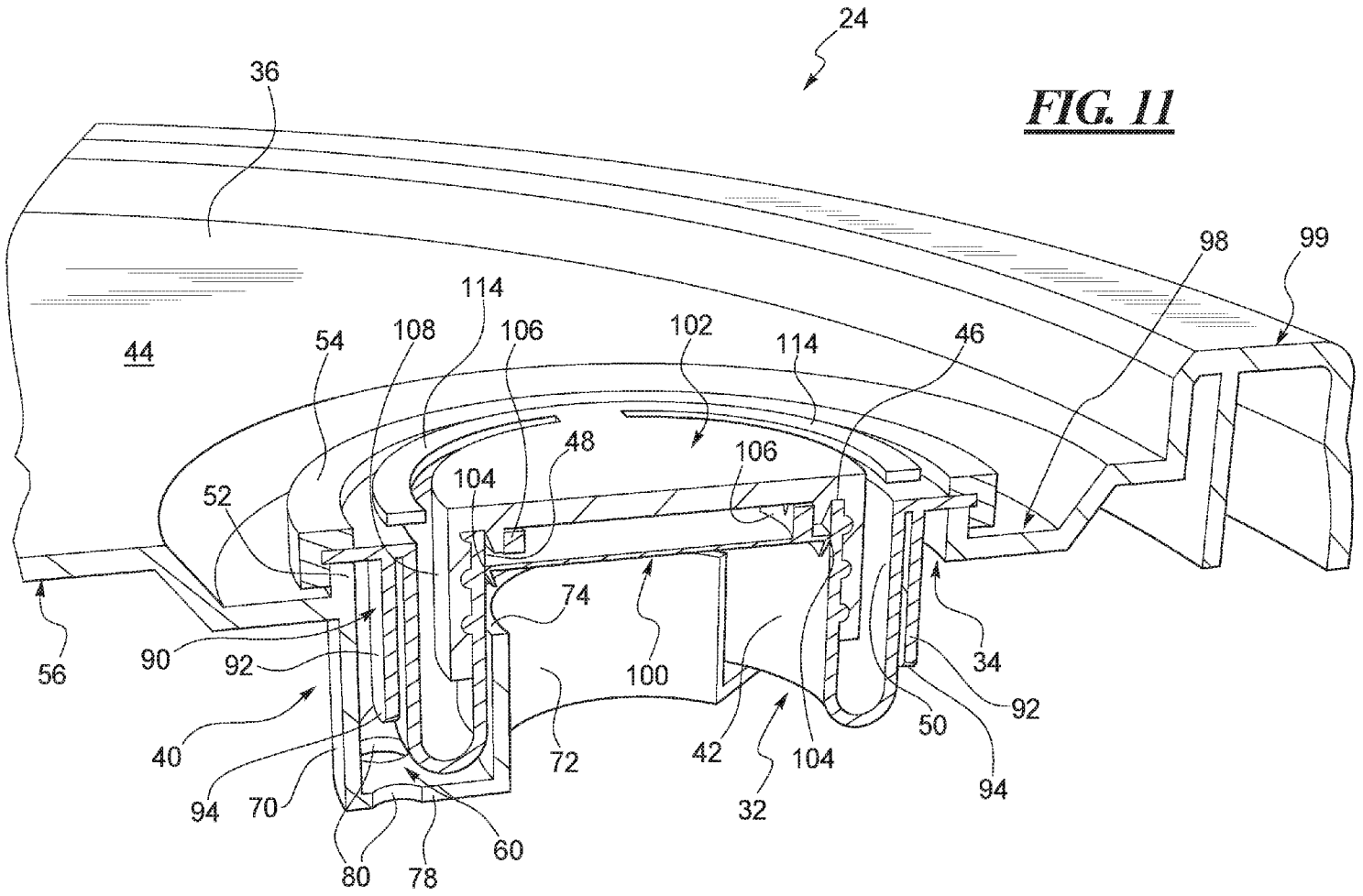
FIG. 11 shows a cross-section of the pour spout of FIGS. 1-4, but in a non-extended configuration and with a tamper-proof diaphragm and a re-usable cap in place.
Figure 12:
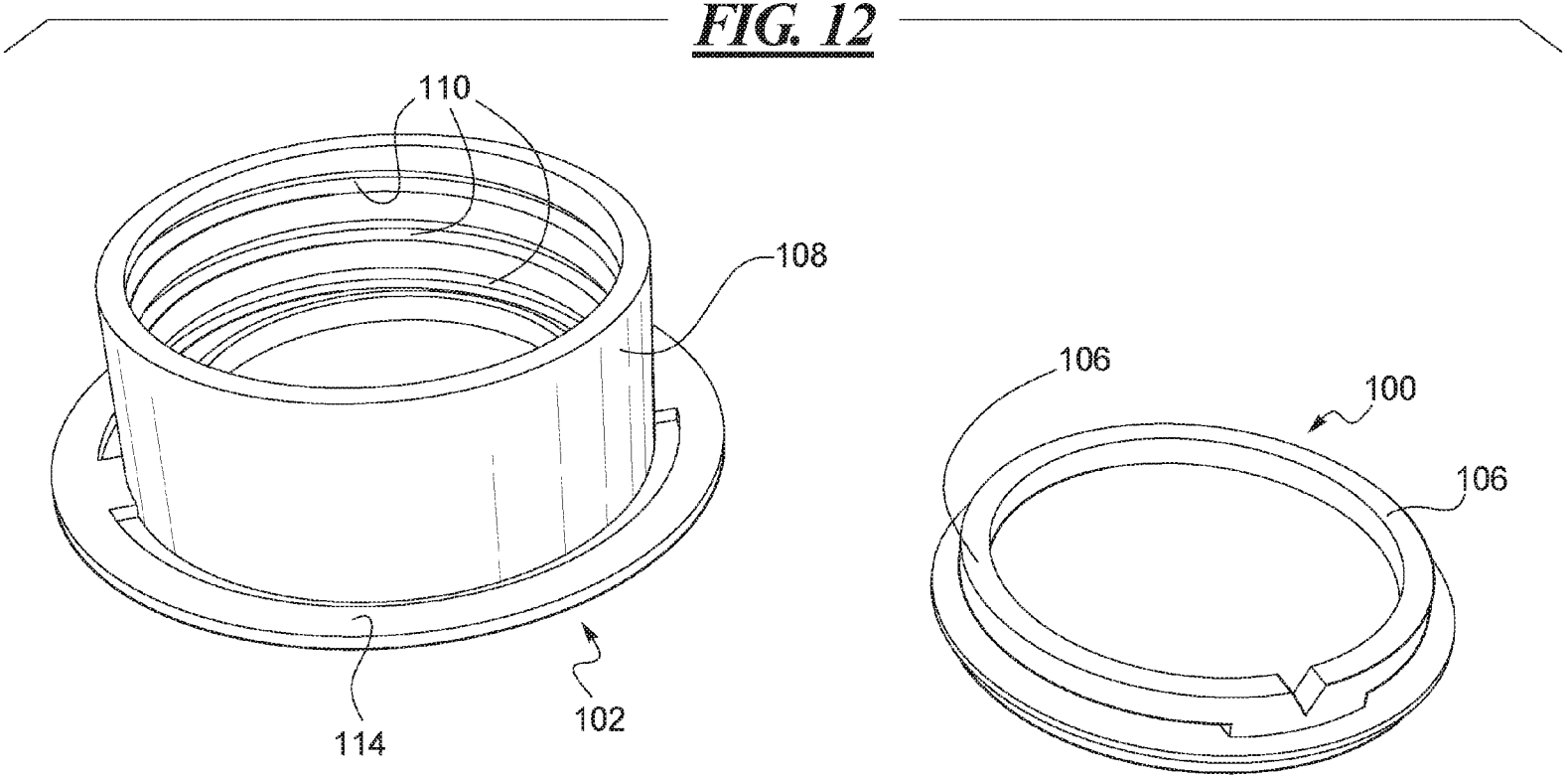
FIG. 12 shows the tamper-proof diaphragm and the re-usable cap after removal from the pour spout of FIG. 11.

FIGS. 11 and 12 show another feature of the disclosed anti-glug device 40 and pour spout 32. The pour spout 32 may have a tamper-proof diaphragm 100 and a re-usable cap 102 for closing the outlet 48 of the pour spout. The pour spout 32 may also be movable between a collapsed condition, as shown in FIG. 11, for shipping and storage and an extended dispensing position, as shown in FIGS. 1-4. The diaphragm, cap, and collapsibility features are generally known in the art. However, these features, if used for a container assembly application, must be compatible with the disclosed anti-glug device.

In this example, the pour spout 32 is movable to a collapsed configuration whereby the larger diameter attaching end 50 is inverted through the dispending orifice 34 to the underside 56 of the lid top wall 36. The spout portion 42 remains directed toward the extended position but, because the attaching end 50 is inverted to the underside 56, the spout portion only extends back to the dispensing orifice 34. As shown in FIG. 11, the pour spout 32 is thus folded between the attaching end 50 and the spout portion 42. The fold seats neatly in the channel 60. Thus, the combination of the pour spout 32 and the channel 60 can be sized to accommodate one another. When lids are shipped, they are typically stacked one on top of the other. One consideration for the anti-glug device 40 is the added height or depth of each lid and whether they lids can nest when stacked. In this example, the lid 24 has a recessed region 98 that allows the outer side 44 of the lid top wall 36 to be relatively flat or flush radially inward of a rim 99 of the lid, with the pour spout 32 collapsed and the cap 102 installed. The protruding dimension of the channel 60 on the underside 56 should be limited by the rim height so that the lids 24 can stack and nest properly.

The diaphragm 100 is a one-time removable, tamper-proof seal diaphragm that closes off the outlet 48. The diaphragm 100 can be provided as a molded part of the pour spout 32 at the liquid outlet 48. The diaphragm 100 can have a frangible connection 104 to the spout portion 42 around the circumference. The diaphragm 100 have grip rings 106 that are joined to the diaphragm by living hinges. The grip rings 106 can be pulled so that the diaphragm 100 can be removed by the purchaser and can provide evidence, if missing or partly removed, that the pour spout 32 has been tampered with. The re-usable spout cap 102 can be provided to cap off the liquid outlet 48 of the spout portion 42. The re-usable cap 102 can have a neck 108 with internal threads 110 and can fit over and screw onto the distal end of the spout portion 42, which can have mating female threads 112. The cap 102 can instead be a snap-on cap or can have female threads that mate with male threads on the spout portion. In another example, the cap can be a frangible integral part of the spout portion for one-time detachment and then for re-use as a cap. The re-usable cap 102 can also have grip rings 114 attached via living hinges to the cap to assist in installing and removing the cap on and from the pour spout 32. These re-usable cap and diaphragm features of existing container spouts of this type can optionally be used in conjunction with the disclosed anti-glug device.

Figure 13:
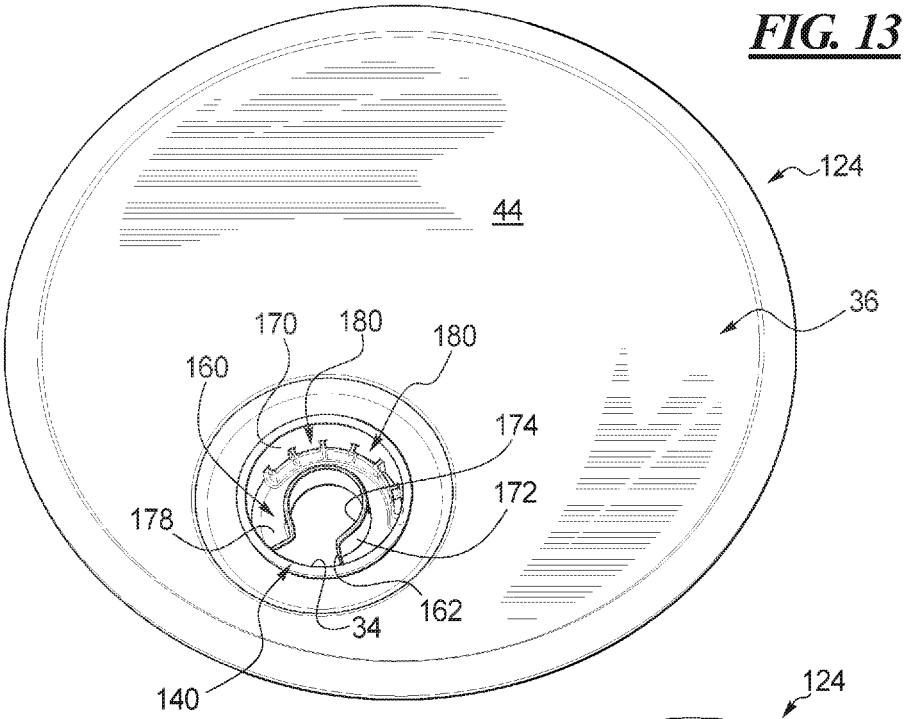
FIG. 13 shows a top perspective view of a lid for a container assembly, the lid including an alternate example of an anti-glug device constructed in accordance with the teachings of the present disclosure.
Figure 14:
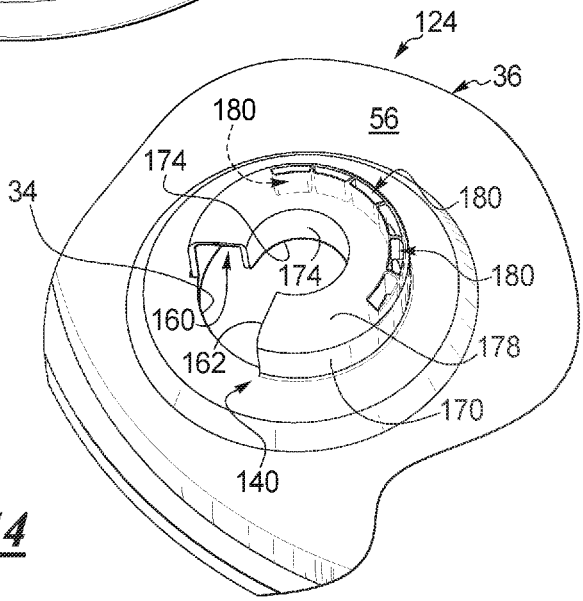
FIG. 14 shows an enlarged bottom perspective view of a portion of the lid of FIG. 13 including the anti-glug device.
Figure 15:
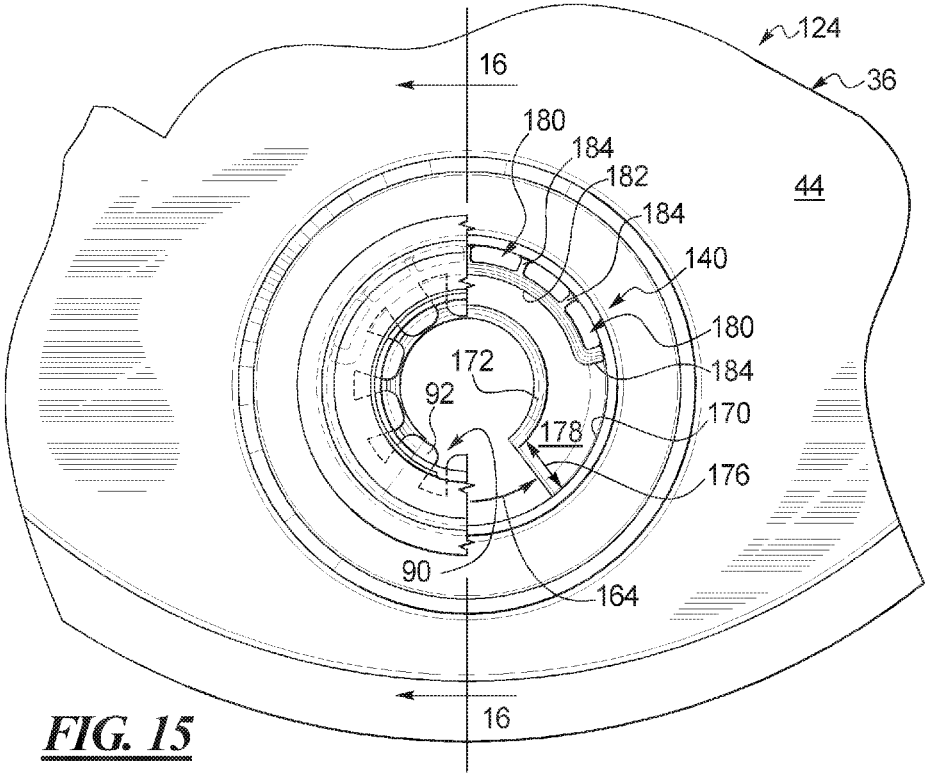
FIG. 15 shows an enlarged top detail view of a container assembly including the lid if FIGS. 13 and 14.

FIGS. 13 and 14 illustrate top and bottom perspective views of a part of another example of an anti-glug device 140 constructed in accordance with the teachings of the present disclosure. FIG. 15 shows a top plan view of the anti-glug device 140, with the complete anti-glug device and pour spout 32 shown on the left-hand side of the figure and just the part of the device (of FIGS. 13 and 14) shown on the right-hand side of the figure. In this example, the anti-glug device 140 is again provided on a lid 124 to create an air vent or venting function that accompanies and enhances performance of the lid and the pour spout 32. The anti-glug device 140 in this example is again positioned on an underside 56 of the lid top wall 36. The anti-glug device 140 is similar to the anti-glug device 40, as described above. In FIGS. 13 and 14, the part of the anti-glug device 140 that is depicted is an integrally molded, contiguous, unitary or monolithic part of the lid 124. However, the entire anti-glug device 140 can instead be one or more separate pieces that are attached to an independently fabricated lid, if desired, and in any suitable manner as noted above.

The anti-glug device 140 in this example includes an annular channel 160 that is the monolithic part of the lid 124. The channel 160 is formed on the underside 56 of the lid top wall 36. The channel 160 only partially circumvents, surrounds, or extends around the dispensing orifice 34. The channel 160 is constructed and arranged so that it does not completely circumvent or extend around the dispending orifice 34. In this example, the channel 160 extends around the orifice more than 270 degrees in circumference, but less than 360 degrees, as best shown in FIGS. 14 and 15. A circumferential gap 164 is created between two terminal ends 162 of the channel 160. The channel 160 has an annular outer wall 170 that is concentric with the liquid flow path P. The outer wall 70 again may have a diameter that is about the same size or diameter as the dispensing orifice 34 and thus the attaching end 50 of the spout portion 42 in this example. The outer wall 170 has a proximal end or edge that is connected to the underside 56 of the lid top wall 36 adjacent the dispensing orifice 34. The channel 160 also has an annular inner wall 172 that is spaced radially inward from the outer wall 170. The inner wall 172 also has a top edge 174, which is again a free exposed edge in that it is not joined to any part of the lid top wall 36. This creates a radial gap 176 or opening in the radial direction into the channel 160 over the inner wall top edge 174. The inner wall 172 is again generally radially aligned with and has a similar diameter as the smaller diameter part of the spout portion 42. In this example, the diameter of the inner wall 172 of the channel 160 is slightly smaller than that of the spout portion 42.

The channel 160 also has a connecting wall 178 that joins the respective bottom edges of the inner wall 172 and outer wall 170 of the channel. The connecting wall 178 extends radially between the spaced apart inner wall 172 and outer wall 170. The connecting wall 178 is generally flat and again is only a semi-circle sized to match that of the circumferential extent of the channel 160. The channel 160 is defined radially between the inner wall 172 and the outer wall 170 and is axially bound or limited by the connecting wall 178. The terminal ends 162 of the channel 160 that face the circumferential gap 164 or split in the channel are open, as shown in FIGS. 13 and 14. The transitions between the various walls and the terminal ends of the inner and outer walls on the anti-glug device 40 of the prior example are sharp. The transitions between the various walls 170, 172, and 178 and the terminal ends 162 on the anti-glug device 140 are gradually curved or rounded in this example.

In this example, the channel 160 of the anti-glug device 140 defines a plurality of air vents 180 formed in a different manner than the holes 80 of the prior example. In this example, the channel 160 has an elongate, circumferential slot formed through the connecting wall 178 as shown in FIG. 14. The slot is positioned adjacent the outer wall 170 on the connecting wall 128. The circumferential length of the slot in this example is less than the circumferential length of the channel 160. In this example, the slot extends less than 180 degrees around the channel. If desired, the radially outer edge of the slot may be partly formed axially in or through the curved or rounded transition between these two walls, or can even be partly formed radially through the outer wall 170 adjacent this rounded or curved transition. In doing so, as in this example, the one or more air vents 180 may be described as extending through the rounded transition between an outer wall and connecting wall of the channel or at least in part radially through the outer wall of the channel.

An intermediate vent wall 182 coincides with the radially inner edge of the slot and extends in an axial direction into the channel 160 between the inner and outer walls 172, 170. A plurality of axial vent partitions 184 are spaced apart from one another in a circumferential direction. The vent partitions 184 extend radially between the intermediate wall 182 and the outer wall 170 and extend in the axial direction. In this example, one vent partition 184 is disposed at each end of the slot and five additional vent partitions are spaced apart therebetween, forming six of the air vents 180. Each of the plurality of air vents 180 is formed between two of the vent partitions 184, the outer wall 170, and the intermediate vent wall 182. The air vents 180 in this example are thus oriented in the axial direction and are created in what might be defined as a vent channel within the channel 160. The size, shape, positioning, and number of the air vents 180 can vary. In the disclosed example, the anti-glug device 140 has six air vents 180, though that number can vary.

As with the anti-glug device 40, the width of the channel 160, defined by the radial spacing of the outer wall 170 and inner wall 172, can vary from the example shown. The positioning of the walls 170, 172 relative to the center axis of the spout portion 42 can also vary from the example shown. In this example, the center axes of the channel 160 and the pour spout 32 are substantially concentric with one another. This may not be the case in some examples as the center axes may be misaligned, as long as the flow path P is open through both the pour spout 32 and the anti-glug device 140. Also, as shown in FIG. 15, the outer wall 170 in this example is about the same size diameter as the dispending orifice 34 and the inner wall 172 is slightly smaller in diameter than the spout portion 42 of the pour spout 32. This also may not be the case in some examples. The foregoing variables can be determined for specific applications, depending on the size and type of container, the size and length of the pour spout and/or spout portion, and the type and viscosity of the liquid to be contained and poured.

Similarly, the depth or height of the channel 160, i.e., the height of the outer wall 170 and the inner wall 172 and, accordingly, the size of the radial gap 176 between the underside 56 of the lid top wall and the top edge 174 of the inner wall, can also vary from the example shown. The height of the channel 160 is determined in part by the height of the inner wall 172 from the connecting wall 178 to the top edge 174 and in part by the height of the outer wall 170 from the connecting wall to the underside 56 of the lid top wall 36. These characteristics can also vary from the example shown herein. As noted above, testing has shown that as the height of the inner wall 172 approaches half the height of the outer wall 170 or less, the effectiveness of the anti-glug device may rapidly deteriorate at least for some liquids. Testing has also shown that, as the circumferential length of the channel 160 is reduced to 180°, i.e., about half the circumference of the pour spout 32, or if the circumferential length is increased closer to a full 360°, i.e., significantly reducing the size of the circumferential gap 164, the performance of the anti-glug device 140 rapidly deteriorates, at least for some liquids. All of the foregoing design characteristics and the size, number, shape, and positioning of the air vents may vary, depending on the liquid characteristics and the container and spout design characteristics of a given application.

Figure 16:
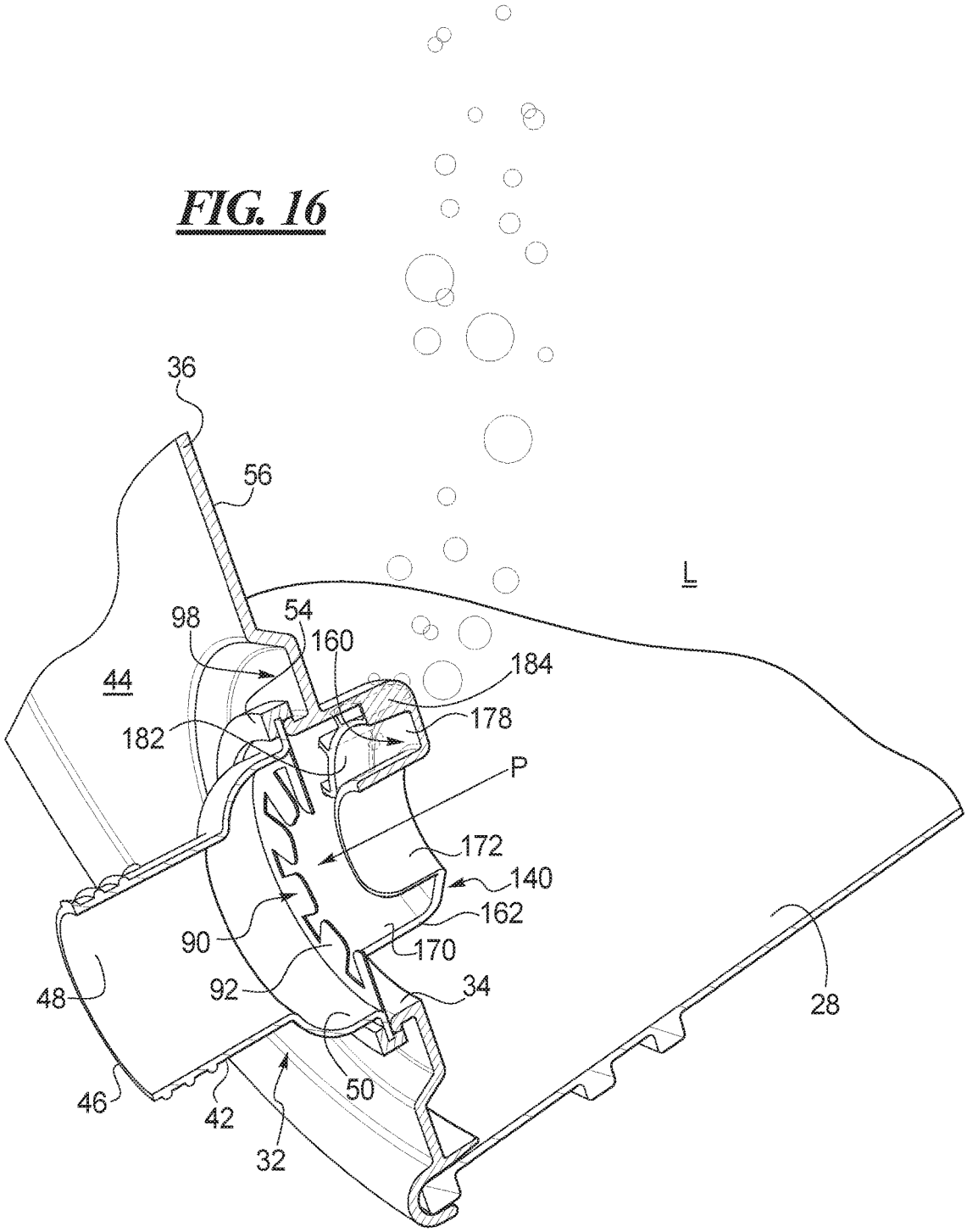
FIG. 16 shows a cross-section taken along line 16-16 of the container assembly of FIG. 15, the container assembly shown inverted and dispensing liquid from a pour spout.

In this example, the circumferential gap 164 is again positioned at the bottom of the flow path P of the pour spout 32 and at the top of a column of liquid L when in the pouring or dispensing position of FIG. 16. Thus, the channel 160 and the air vents 180 are positioned around the top of the flow path P and at the top of the liquid column L in the pouring or dispensing position.

Still further, the channel 160 of the anti-glug device 140 is shown and described herein as being a contiguous, integral, unitary or monolithic part of the lid 124. As such, the channel 160 can be molded as a part of the lid 124 in the same mold cavity and of the same material. The channel 160 would also require very little to no additional resin material to manufacture. Thus, the channel 160 would require no additional manufacturing steps, other than in the initial tooling of the mold cavity, and would add almost no additional cost to create and add the feature of the anti-glug device 140 to the lid 124. In fact, the disclosed anti-glug device 140 can reduce lid cost by eliminating the need to manufacture, store, and install a separate vent part on each manufactured lid. The substantial anti-glug benefit can thus be gained with virtually no added cost or complexity, and perhaps even with a slight reduction in cost and complexity, to the design and manufacture of the lid or container assembly. However, it is certainly possible that the channel be created as a separate component, which is then after-assembled to the lid, if desired. Such a separate channel could be attached to the lid using any suitable process such as an applied adhesive, chemical bonding, heat welding, metal welding, screw threads, fasteners, press-fit, or the like.

With reference to FIGS. 15 and 16, the anti-glug device 140 can also include the liquid column restrictor 90 that at least slightly restricts the flow path P otherwise defined by the pour spout 32. The restrictor 90 is again positioned to restrict at least a portion of the liquid column as it is dispensed from the container assembly 20. In this example, the liquid column restrictor 90 has the plurality of flexible fingers 92, which surround the flow path P and extend radially inward toward the axis of the flow path P and are formed and function as described above.

Figure 17:
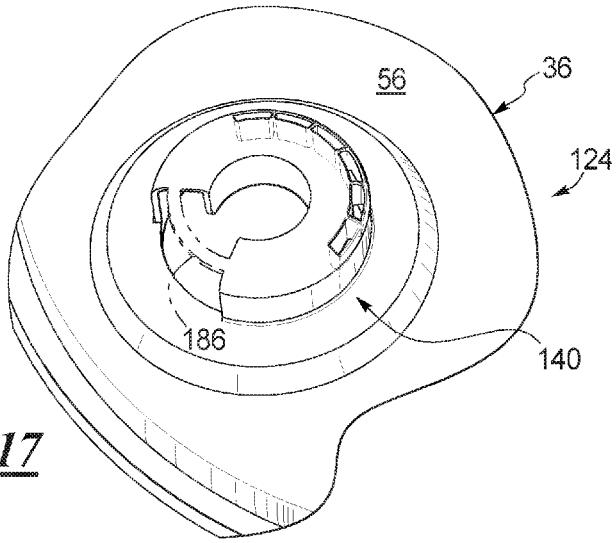
FIG. 17 shows a bottom perspective view of a lid having another example of an anti-glug device constructed in accordance with the teachings of the present disclosure.

It will become evident to those having ordinary skill in the art that modifications may be made to the disclosed anti-glug devices within the spirit and scope of the present disclosure. In one example, as depicted in FIG. 17, one such modification may be made without substantially affecting or limiting aspects of the circumferential gap 64 or 164 in the channel 60 or 160. The flow characteristics of the anti-glug devices and pour spout may remain substantially the same, even though a limited portion of the channel is formed as being circumferentially continuous around the entire channel. In this example, the anti-glug device 140 is depicted having a material band 186 that may extend across the circumferential gap 164 between the terminal ends 162 of the channel 160. The size, i.e., the width and/or thickness of the material band 186 may be such that it does not significantly or substantially affect the liquid flow characteristics of the anti-glug device and pour spout. As used herein, a channel having a circumferential gap may include complete separation of the channel between the terminal ends or may include such a material band between the terminal ends, which still effectively leaves or maintains the existence of the circumferential gap. Likewise, such a material band may be provide extending between ends of the outer wall, the connecting wall, and/or the inner wall.

The foregoing anti-glug device and pour spout examples are described with some specificity and detail. However, the invention and the scope of the appended claims are not intended to be limited only to the disclosed and described examples. Changes and modifications can be made to the disclosed anti-glug device examples, as well as the lids, containers, and pour spouts, without departing from the spirit and scope of the disclosure. Also, specific combinations of aspects, features, parts, and components are provided for the disclosed anti-glug devices, pour spouts, lids, and containers. However, the disclosure and the scope of the appended claims are not intended to be limited to only the specific combinations disclosed. Other combinations of these aspects, features, components, and parts can and are intended to fall within the spirit and scope of the present disclosure. Each aspect, feature, part, and component disclosed and described herein may be utilized alone or may be combined with one or more of the other features, aspects, parts, and components.

The disclosed anti-glug devices, corresponding pour spout features, containers, and lids can be fabricated using higher tech materials and molding processes and techniques. However, the disclosed concepts also may be suitable for lower tech materials and molding or other fabrication processes and techniques. The disclosed lids, pour spouts, containers, and/or anti-glug devices, as well as parts thereof can be formed of a polymer material and can be blow molded or injection molded. The parts and components can alternatively be made from other suitable materials or can be formed of rigid polymer materials, composite materials, metals, or combinations thereof. The disclosed anti-glug device can be fabricated for continued use and durability or can be fabricated for limited or one-time use as a disposable item along with the containers and/or lids. The materials used can be recycled plastic material and/or the can be recyclable as well. The disclosed containers, lids, anti-glug devices, and pour spouts can be fabricated in various combinations of separate assembled parts, such as the tubular spout portion, the lid, and the anti-glug device or can be formed as integral parts of the lid or the container. The parts can each be fabricated from different materials or from the same material.

The disclosed anti-glug device examples provide a reliable, inexpensive, leak-free venting solution for liquid containers, such as buckets and pails that utilize lids. However, the anti-glug devices can also be utilized on other types of containers and with other types of spouts and may function as intended. These containers can include fuel cans, gas cans, oil cans, chemical containers, and the like. The disclosed anti-glug devices provide an inexpensive solution for existing pour spout designs that also create an air vent feature on containers. The disclosed anti-glug devices and spout assemblies combine to establish a fluid outlet for dispensing liquid from the container while also establishing and maintaining an airway from the outlet back into the container interior. The disclosed anti-glug devices and spout assemblies allow for uninterrupted flow of liquid from the container. The disclosed anti-glug devices eliminate or substantially reduce the glugging effect created in conventional containers caused by air returning or entering the container through the liquid flow path, which interrupts the flow of liquid.

The wall of the spout portion can at least be partially corrugated or fluted. The flutes or corrugations can be circumferential around the tube of the spout so as to add flexibility to the pour spout, if desired. Optional combinations of fluted portions and non-fluted portions can add a desired or predetermined amount of stiffness or rigidity and/or flexibility to the tubular spout portion, as needed or desired for a particular application. In this example, providing the tubular spout portion with a degree of intended flexibility can allow the spout portion or pour spout to bend during use. This allows the spout portion to be more easily directed into a receiving vessel with less precision and without having to tip the container as much as if the spout were straight and stiff.

The disclosed anti-glug devices restrict liquid flow into the pour spout and to the liquid outlet. The restriction assures that the pour spout portion does not completely fill with liquid and allows back flow of atmospheric air into the pour spout portion. The disclosed anti-glug device is configured to place at least some of the air vents and at least a portion of the channel above the liquid flow path in the pouring orientation. If the air vents and/or channel are below the liquid flow path during pouring, the disclosed anti-glug device example may not work.

The disclosed anti-glug device concepts provide some important advantages. For one, no glugging action greatly reduces spillage/splashing of liquid being poured. This can significantly increase safety, particularly when pouring hazardous or dangerous liquids. For another, the concept is a low cost improvement over existing options. The anti-glug devices can be molding directly onto or as a part of the lid or other container part. No extra closures or assembly labor is required. For yet another, improved performance is achieved over existing solutions. The anti-glug device concepts are inside of the container or pail and do not interfere with hydrostatic tests required for hazardous liquids. Also, pouring is smoother and faster with no glugging. For still another, flow accuracy is greatly improved. Flow accuracy may vary by only 0.5 inches compared to up to six inches or more when pouring without a vent and thus with the glugging effect.

Although certain containers, anti-glug devices, spout assemblies, lids, and combinations, parts, components, and optional features and aspects thereof have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A lid for a liquid container, the lid comprising:
- a lid wall having a perimeter, a top side surface, and an underside surface; and
- an anti-glug device carried on the lid wall and positioned to coincide with a dispensing orifice in the lid wall, the anti-glug device including
  - a channel that partly circumferentially surrounds the dispensing orifice,
  - terminal ends of the channel, the terminal ends defining a circumferential gap therebetween, and
  - one or more vents formed at least in part through a wall of the channel, said wall upstream from said lid wall, the one or more air vents disposed circumferentially opposite the circumferential gap.

2. A lid according to claim 1, further comprising:
- a pour spout including a spout portion carried by and extending from part of the lid wall, the pour spout having an outlet and defining a liquid flow path in fluid communication with the dispensing orifice.

3. A lid according to claim 1, wherein the anti-glug device is integrally formed as a contiguous unitary part of the lid wall.

4. A lid according to claim 1, wherein the anti-glug device further comprises:
- an outer wall connected to the lid wall and protruding away from the underside of the lid wall;
- an inner wall spaced radially inward of the outer wall; and
- a connecting wall spaced from the underside surface of the lid wall and joining the outer and inner walls.

5. A lid according to claim 4, wherein the channel is defined between the outer wall and the inner wall and by the connecting wall, and wherein each of the inner, outer, and connecting walls only partly circumferentially surrounding the dispensing orifice.

6. A lid according to claim 4, wherein the one or more air vents are formed at least in part through the connecting wall of the channel.

7. A lid according to claim 6, wherein the one or more air vents is a plurality of holes formed through the connecting wall.

8. A lid according to claim 4, wherein the inner wall forms a portion of a liquid flow path radially inward of the inner wall.

9. A lid according to claim 1, further comprising:
- a pour spout including a spout portion carried by and extending from part of the lid wall, the pour spout having a liquid outlet and defining a liquid flow path in fluid communication with the dispensing orifice; and
- the anti-glug device including
  - an outer wall connected to the lid wall and protruding away from the underside of the lid wall,
  - an inner wall spaced radially inward of the outer wall, and
  - a connecting wall spaced from the underside surface of the lid wall and joining the outer and inner walls.

10. A lid according to claim 9, wherein the inner wall has a diameter that is equivalent to or less than a diameter of the liquid outlet and at least part of the spout portion.

11. A lid according to claim 9, wherein the inner wall is sized to restrict liquid flow into the spout portion.

12. A lid according to claim 11, further comprising a flow restrictor along the liquid flow path downstream of the inner wall and configured to restrict liquid flow into the spout portion.

13. A lid according to claim 9, wherein the outer wall has a diameter that is greater than a diameter of the spout portion at the liquid outlet.

14. A lid according to claim 1, wherein the anti-glug device is configured to create a return air flow path above a liquid flow path through the dispensing orifice when the lid is in a pouring orientation.

15. A lid according to claim 14, wherein at least part of the channel of the anti-glug device is positioned above the liquid flow path when in the pouring orientation.

16. A lid according to claim 14, wherein the one or more air vents are positioned above the liquid flow path in the pouring orientation.

17. A lid according to claim 2, wherein the spout portion has an attachment end connected to the lid wall, the attachment end having a larger diameter than a diameter of the spout portion nearer the liquid outlet.

18. A lid according to claim 1, wherein the channel has an annular circumferential shape.

19. A lid according to claim 1, wherein the terminal ends of the channel are open.

20. A lid according to claim 1, wherein the circumferential gap extends at least 90 degrees but less than 180 degrees around the dispensing orifice, and wherein the terminal ends are open.

21. A lid according to claim 1, wherein the channel further comprises:

a slot extending partially circumferentially around the channel and disposed opposite the circumferential gap;

an intermediate wall spaced radially inward of an outer wall of the channel, the slot disposed between the intermediate wall and the outer wall;

a plurality of vent partitions spaced apart along the slot and between the intermediate wall and the outer wall; and the one or more air vents including a plurality of air vents defined between the vent partitions.

22. A lid according to claim 1, wherein the terminal ends of the channel are connected by a band of material that is sized to otherwise leave the circumferential gap between the terminal ends.

23. A lid according to claim 1, wherein the one or more air vents are formed at least in part axially through a rounded transition between an outer wall and a connecting wall of the channel or at least in part radially through the outer wall of the channel.

24. A container assembly comprising:

a container having a top opening and defining a space therein; and the lid of claim 1 coupled to the container to close off the top opening.

25. An anti-glug device for a liquid container, the anti-glug device comprising:

a channel that is in flow communication with a dispensing orifice of a container, the channel partly circumferentially surrounding the dispensing orifice;

terminal ends of the channel, the terminal ends defining a circumferential gap therebetween, the circumferential gap being less than 180 degrees around said dispensing orifice; and one or more air vents formed at least in part through a wall of the channel, said wall is oriented orthogonally with respect to a liquid flow direction through said dispensing orifice, the one or more air vents disposed circumferentially opposite the circumferential gap.

* * * * *